US008870719B2

(12) United States Patent
Johnson et al.

(10) Patent No.: US 8,870,719 B2
(45) Date of Patent: Oct. 28, 2014

(54) ALL IN ONE FITNESS BALL

(71) Applicants: Carl W. Johnson, Houston, TX (US); Lawrence C. Kiliszewski, Magnolia, TX (US)

(72) Inventors: Carl W. Johnson, Houston, TX (US); Lawrence C. Kiliszewski, Magnolia, TX (US)

( * ) Notice: Subject to any disclaimer, the term of this patent is extended or adjusted under 35 U.S.C. 154(b) by 0 days.

(21) Appl. No.: 14/165,529

(22) Filed: Jan. 27, 2014

(65) Prior Publication Data

US 2014/0141944 A1 May 22, 2014

Related U.S. Application Data

(63) Continuation-in-part of application No. 12/969,985, filed on Dec. 16, 2010, now Pat. No. 8,636,625.

(51) Int. Cl.
*A63B 23/14* (2006.01)

(52) U.S. Cl.
USPC ..... 482/93; 482/44; 482/45; 482/46; 482/50

(58) Field of Classification Search
USPC ..... 482/44–50, 92, 93, 136, 137, 148; 434/247
See application file for complete search history.

(56) References Cited

U.S. PATENT DOCUMENTS

| | | | | |
|---|---|---|---|---|
| 5,242,348 | A | 9/1993 | Bates | |
| 5,800,311 | A | 9/1998 | Chuang | |
| 6,387,022 | B1 | 5/2002 | Smith | |
| 6,773,377 | B1 | 8/2004 | Yu et al. | |
| 7,175,573 | B1 * | 2/2007 | Huang | 482/110 |
| 7,381,157 | B2 * | 6/2008 | Blateri | 482/50 |
| 7,883,452 | B1 * | 2/2011 | Chen | 482/93 |
| 2001/0001094 | A1 | 5/2001 | Panes | |
| 2012/0302407 | A1 | 11/2012 | Kelliher | |

* cited by examiner

*Primary Examiner* — Glenn Richman
(74) *Attorney, Agent, or Firm* — Gordon G. Waggett, P.C.

(57) ABSTRACT

A new weighted ball exercise device is disclosed. The ball has handles connected to covers located on opposite sides of the ball. The handles rotate 360 degrees clockwise or counter-clockwise. The handles alleviate stress on the user's wrists and provide a firm grip. The ball has an internal weight storage compartment or weight drawer that may be opened to permit adding or removing weights of various sizes and weights. The compartment can be axially located between the covers, and be locked and unlocked by action of spring-loaded button mechanism. In another embodiment, the ball has opposing rotatable covers with handles and grips. Weights are removably insertable into one or more recessed compartments located about the ball's outer surface, and may be radially spaced apart. A kettle bell handle attachment can be inserted into the outer surface to permit conversion of the ball to a kettle ball device.

23 Claims, 26 Drawing Sheets

ALL IN ONE FITNESS BALL

CROSS-REFERENCE TO RELATED APPLICATIONS

This application is a continuation in part of application Ser. No. 12/969,985, filed Dec. 16, 2010, issuing on Jan. 28, 2014 as U.S. Pat. No. 8,636,625. The patent application identified above is incorporated herein by reference in its entirety to provide continuity of disclosure.

STATEMENT REGARDING FEDERALLY SPONSORED RESEARCH OR DEVELOPMENT

Not Applicable.

BACKGROUND OF THE INVENTION

Medicine ball training is one of the oldest forms of strength training. One of the earliest forms of the medicine ball is found in Persia nearly 3000 years ago and Ancient Greece. These early forms were made from animal skins stuffed with sand. These early medicine balls were used for strength and conditioning training, and injury prevention and rehabilitation. Medicine balls are stilled for these purposes today, but the structure of the medicine ball has evolved.

Medicine balls are constructed of nylon cloth which is covered with leather or vinyl. They are filled with an impact absorbing material which gives them their weight. Some medicine balls are made of rubbery material and consist of having an inner rubber bladder covered with an outer rubber shell. These types of medicine balls are used in exercises where bouncing is required.

Also, medicine balls can have variations on the outside structure of the ball. Typically, a medicine ball is a spherical form which is the ball and nothing more. However, various manufactures have been incorporating the use of handles on or into the ball. Some balls have one handle while others have two with one on each side. Handles allow the user to grasp and swing the ball which alleviates strain on the wrists. Some balls incorporate a rope which passed through the center of the ball and is knotted on the end. This allows the user to swing the ball with little strain. Other balls incorporate a bar that also passes through the center of the ball, so the ball is placed in the center of the bar.

Medicine balls provide various ways to facilitate functional strength training. Instead of focusing on only one muscle group, exercises utilizing the medicine ball make the trainee use multiple muscle groups at once. One main exercise use of medicine balls is to improve core strength. The core of the human body relates to the abdominals, lower back, hips and spine. The medicine ball can also be used to improve stability, upper and lower body strength.

Medicine balls can also be used for rehabilitation after an injury. Rehabilitative exercises with a medicine ball will improve joint integrity and strengthen the muscles with light resistance.

SUMMARY OF THE INVENTION

The present invention provides a new structure to the medicine ball. In the preferred embodiment of the present invention, the weighted ball can have a predetermined diameter of at least 33 inches. However, the diameter of the ball can vary from small, medium or large to accommodate user. The All In One Fitness Weight Ball can be constructed of soft plastic, rubbery and metal materials. It has handles on each side of the ball which rotate 360 degrees clockwise or counter clockwise. The handles alleviate stress on the wrists and provide a firm grip. An innovative feature of the present invention is the removable weights. The weights are fitted over a metal shaft that is positioned within the interior of the ball structure. The metal shaft is attached into to one of the handles and is positioned into the interior of the ball which is hollow. One particular handle has a push button on it, so that when the button is depressed the handle and metal shaft become removable to allow for the insertion of weights. The All In One Fitness Weight Ball uses weights that start at two pounds, but can vary in weight.

In one embodiment there is disclosed an athletic apparatus comprising: a geometrical structure having an interior area with a first removable cover and an opposing and in parallel relation second removable cover, the first cover and the opposing second cover being independently rotationally mounted to the geometrical structure; handles attached to an outer surface area of the first and second covers; an internal chamber centrally disposed within the interior area of the geometrical structure, the internal chamber slidably receiving a shaft member; one or more compartments disposed along a longitudinal axis of the shaft member, each of the one or more compartments having an aperture configured to receive a weight of a predetermined weight amount; and a push button located on an exterior surface area of the geometrical structure being operationally connected through the interior area of the geometrical structure to the shaft member wherein depression of the push button causes the shaft member to be released from the internal chamber.

Another athletic apparatus comprises: a geometrical structure having an interior area with a first removable cover and an opposing and in parallel relation second cover, the first cover and the opposing second cover being independently rotationally mounted to the geometrical structure; handles attached to an outer surface area of the first and second covers; an internal chamber centrally disposed within the interior area of the geometrical structure, wherein the internal chamber comprises a recessed lip and the recessed lip comprises a recessed lip indented area, the internal chamber slidably receiving a shaft member; one or more compartments disposed along a longitudinal axis of the shaft member, each of the one or more compartments having an aperture configured to receive a weight of a predetermined weight amount; and a release button located on the exterior surface of the first removable cover, of the geometrical structure, whereby the opposite end of the release button comprises a release button hook that locks onto the recessed lip indented area, wherein depression of the release button causes the release button hook to unlock from the recessed lip indented area, thereby causing the first removable cover and shaft member to be simultaneously released from the internal chamber.

The athletic apparatus preferably comprises a geometrical structure that is spherical, although other shapes can be suitable.

The first and second covers may further comprise a recessed section directly below the handles forming a gripping area for a hand of a user. The handles themselves can further comprise grips. This gripping area and/or grips can be ergonomically designed.

In yet another embodiment, there is disclosed an athletic apparatus comprising: a geometrical structure having a main body comprising an interior area, an outer surface, a first cover and a second cover opposing and in parallel relation with the first cover, the first cover and the opposing second cover being independently rotationally mounted to opposing sides of the main body; handles attached to an outer surface area of each of the first and second covers; one or more compartments located about the outer surface of the main body, each of the one or more compartments configured for receiving a weight of a predetermined weight amount. Again, the geometrical structure is preferably spherical, or contains a circular surface radially disposed about an axis of rotation between each opposed handle to permit the user to grip the handles and roll the device along a surface. Much like described above, the opposed handles can also contain grips and recessed gripping area ergonomically designed for the user's hands to grip the handles.

In one embodiment, the one or more compartments extend inwardly into the interior area. In this embodiment, the opposed covers rotate about an axis, and the one or more compartments are spaced radially about the axis on the geometrical structure outer surface. One suitable orientation is where the one or more compartments comprise a plurality of evenly spaced-apart compartments that are flush with the geometrical structure outer surface and extend inwardly therefrom into the interior area. Multiple compartments may be employed, and in one embodiment, there are eight compartments.

The athletic device may be equipped with one or more weight cartridges capable of receiving and holding one of the weights, the one or more weight cartridges being insertable into and removable from the one or more compartments. The weight cartridge may further comprise two opposing weight cartridge locking tabs and two opposing weight cartridge release ears to facilitate locking the cartridge into the device, and locking the weight into the cartridge in a manner permitting insertion and removal of cartridge into and out of the compartment, and permitting insertion and removal of a weight from the cartridge. The weights may employ a weight grip to assist in removal of the weight.

One modification of the device includes the use of a kettle bell attachment member attachable to the geometrical structure. The kettle bell attachment can be removably attachable to one of the one or more compartments. The kettle bell attachment may further comprise a kettle bell handle, a kettle bell handle bottom end, and a common base, whereby the kettle bell handle bottom end is permanently connected to the common base, and the common base is removably connectable to the one or more compartments. The common base may further comprise two opposing common base locking tabs and two opposing common base release ears.

BRIEF DESCRIPTION OF THE DRAWINGS

It will be appreciated that the present invention may take many forms and embodiments. In the following description, some embodiments of the invention are described and numerous details are set forth to provide an understanding of the present invention. Those of ordinary skill in the art will appreciate, however, that the present invention may be practiced without those details and that numerous variations and modifications from the described embodiments may be possible. The following description is thus intended to illustrate and not to limit the present invention.

DETAILED DESCRIPTION

Reference is now made to the drawings, which depict preferred embodiments of the present invention, but are not drawn to scale.

Figures 1, 1A, 1B, 1C:
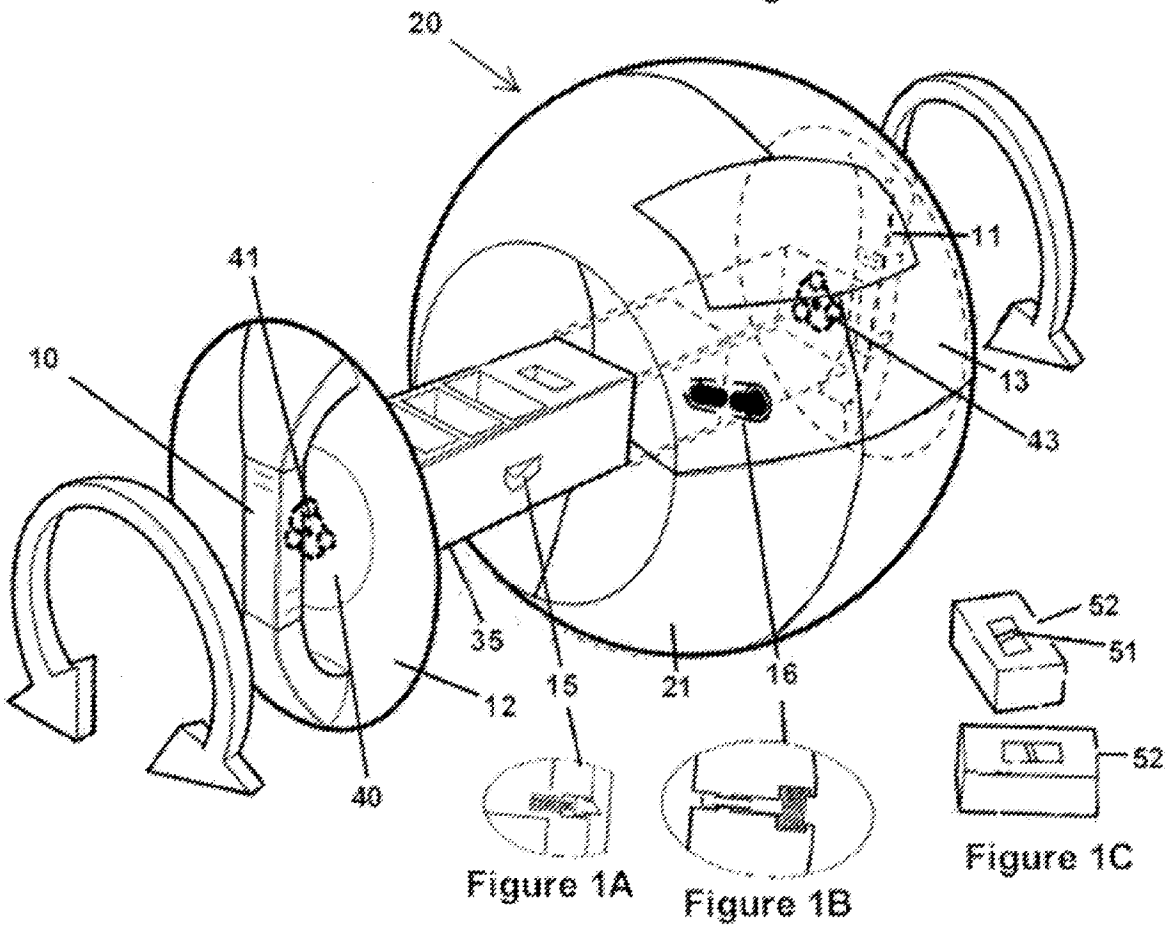
FIG. 1 is an exploded perspective view of the present invention with shaft removed.
FIG. 1A is a cutaway view of the spring-loaded button.
FIG. 1B is a cutaway view.
FIG. 1C is a cutaway view of the weights.

Referring now to the drawings, especially FIG. 1, there is illustrated an exploded perspective view of one embodiment the present invention. In the preferred embodiment, the fitness ball (20) comprises a geometrical structure (21) that is hollow internally. In the preferred embodiment, the geometrical structure (21) is spherical. However, the geometrical shape of structure (21) is not limited. The structure (21) further comprises opposing covers (12, 13) at each end. In the depicted embodiment, each cover (12, 13) is circular in nature and has a recessed section (40, 42) in the center. Handles (10, 11) are attached to each cover (12, 13). As shown, each handle (10, 11) arcs over the recession section (40, 42) within each cover (12, 13) and attach at the sides of the covers (12, 13). Each end of the handles (10, 11) is fixably attached to each side of the covers (12, 13).

Figure 2:
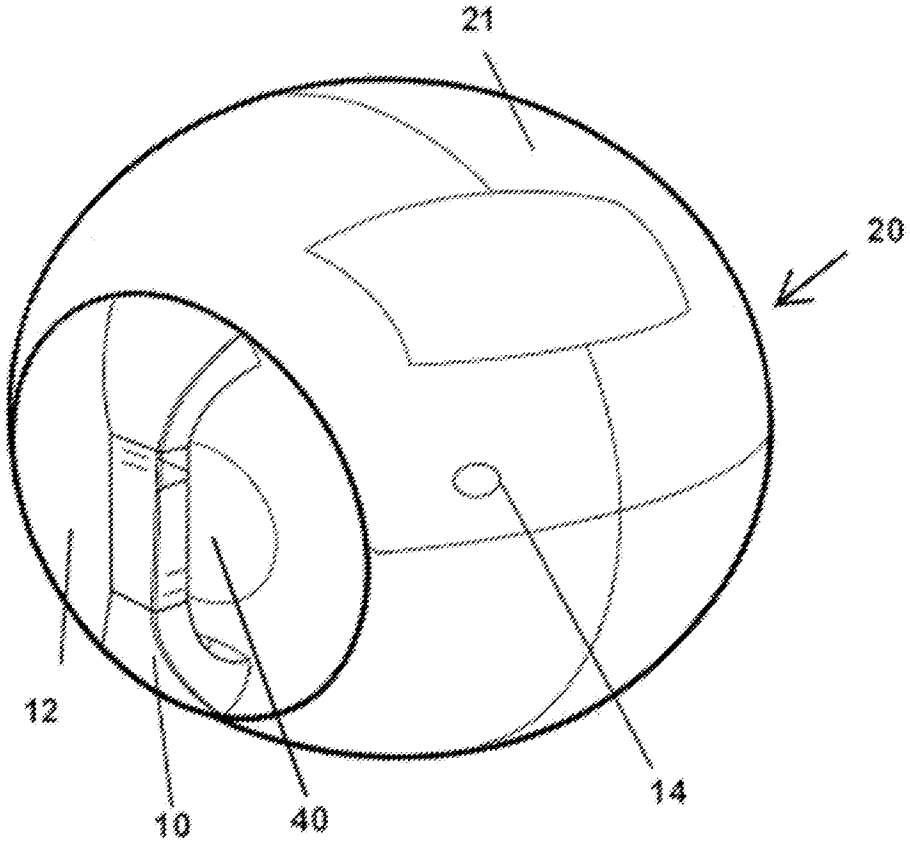
FIG. 2 is a perspective view of the medicine ball with the shaft in place.

A unique feature of the present invention depicted in FIG. 2 is the push button (14) which allows the user to change the weight of the fitness ball (20). In operation, a push button (14) is operationally connected within the geometrical structure (21) as illustrated in FIG. 2. Referring to FIG. 1A and FIG. 1B, when the button (14) is depressed, it triggers a spring-loaded button (15) internally disposed within the structure (21) that is attached to the shaft (35). As shown in FIG. 1A, the spring-loaded button (15) on the shaft (35) depresses into a hole (16) in the shaft (35) which allows it to lie flat against the interior wall of the geometrical structure (21). This process unlocks the shaft (35) which is slidably engaged within the structure (21) and allows the user to remove the shaft (35). When the user slides the shaft (35) into the structure (21), the spring-loaded button (15) will go into the hole (16) and lie flat. Once the shaft (35) is in place, the spring-loaded button (15) fits into a hole (16) in the interior wall. This process allows the shaft (35) to lock in place as shown in FIG. 1.

Figure 3B:
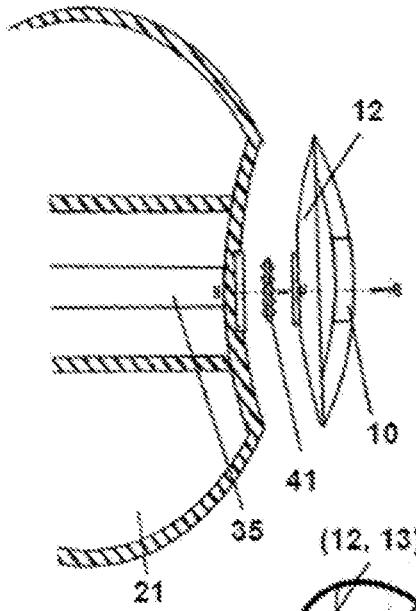
FIG. 3B is a side view of the cover and placement of ball bearing.
Figure 3A:
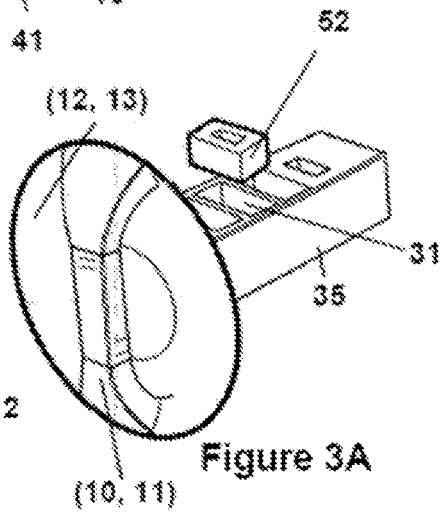
FIG. 3A is a perspective view of the shaft.
Figure 3:
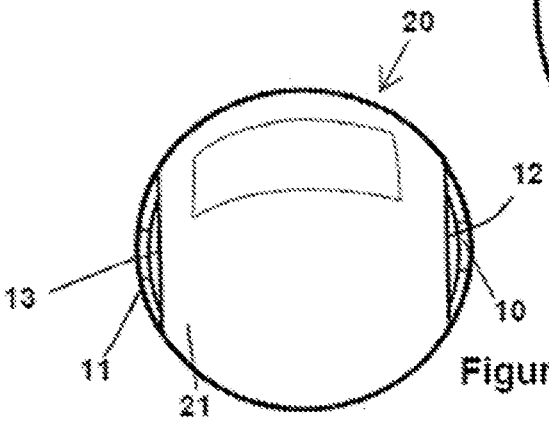
FIG. 3 is a side view of the present invention.

FIG. 3 shows the shaft (35) locked in place. Referring to FIG. 3A, the internal shaft (35) is illustrated. The shaft (35) is attached to opposing removable covers (12, 13) and therefore is removable from the structure (21). In the preferred embodiment, the shaft (35) is rectangular in structure and contains a plurality of compartments (31) aligned along the longitudinal axis of the shaft (35). Each compartment (31) is a recessed area into the shaft (35). The compartments (31) allow the trainee to place weights (52) of various sizes into the shaft (35). This allows the trainee to control the weight of the fitness ball (20).

FIG. 1C illustrates one embodiment of weights (52) that accompany the fitness ball (20). The weights (52) are rectangular in structure and have a centrally disposed depression within the upper surface area of the weight (52). The weights (52) are designed to sit within the compartments (31) inside the shaft (35) as shown in FIG. 1.

Figure 3C:
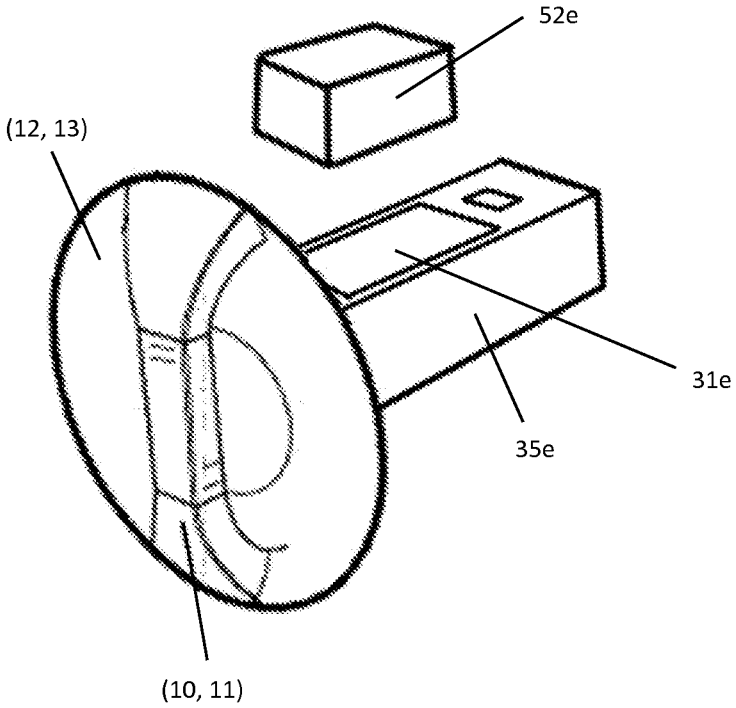
FIG. 3C is a perspective view of an alternative embodiment of shaft comprising a single compartment to receive a single weight.
Figure 4:
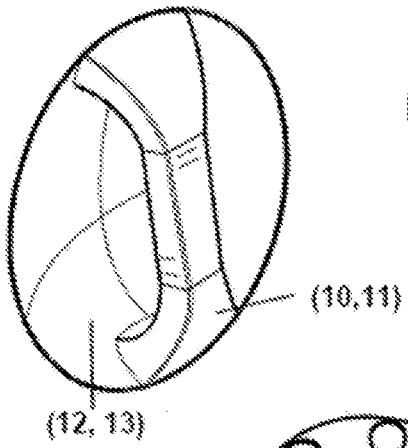
FIG. 4 is a perspective view of the handle.
Figure 5A:
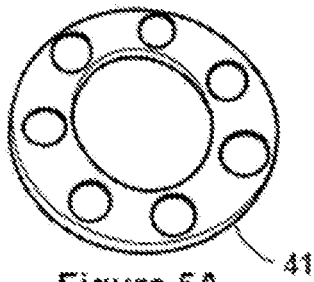
FIG. 5A is a perspective view of the ball bearing.
Figure 5B:
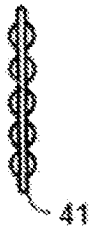
FIG. 5B is a side of view of FIG. 5A.
Figure 6A:
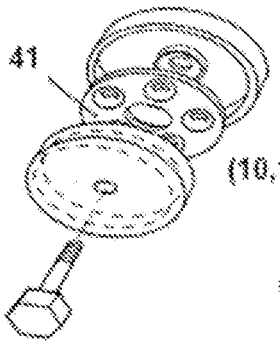
FIG. 6A is an exploded view of ball bearing.
Figure 6B:
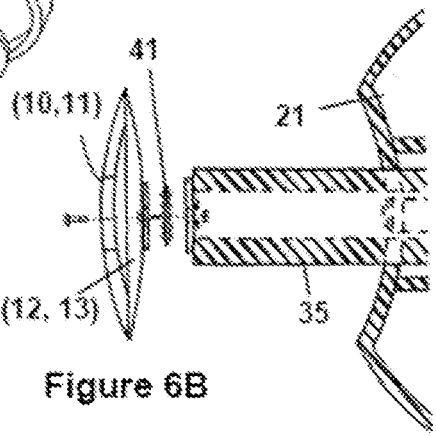
FIG. 6B is a cross-sectional view of the cover.

FIG. 3C illustrates an alternative embodiment of shaft (35*e*) that comprises a single compartment (31*e*) for receiving preferably a single weight (52*e*).

Figure 8:
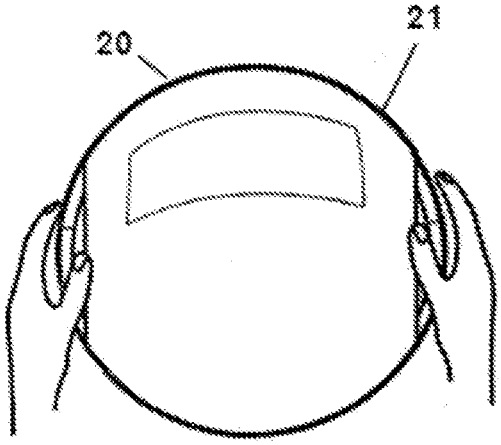
FIG. 8 is a cut away view of the hand placement on the device.
Figure 8A:
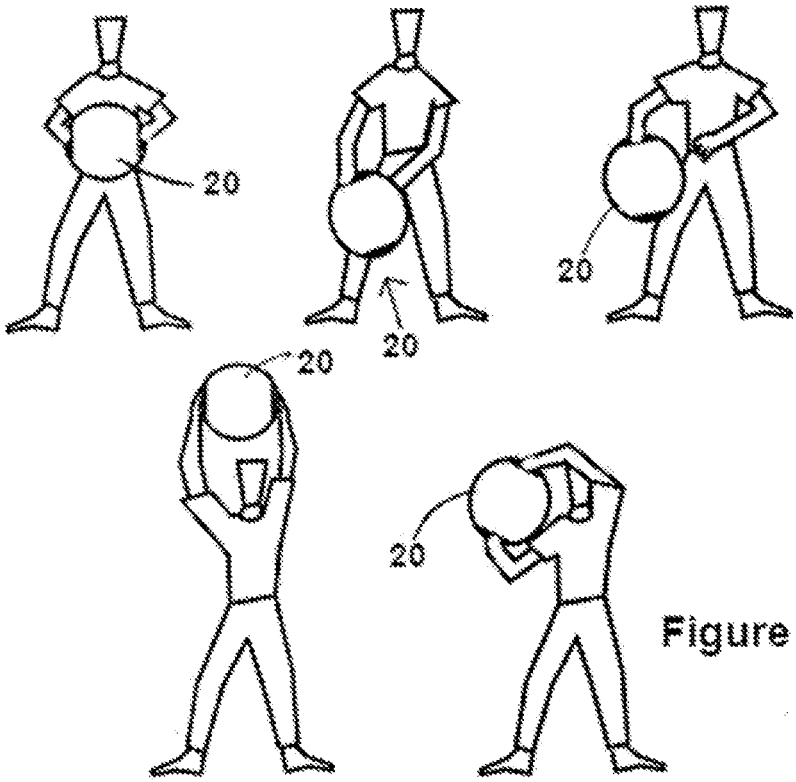
FIG. 8A is an operational view of various poses of a trainee using the device.

Referring to FIGS. 5A, 5B, 6A and 6B, the ball bearings (41, 43) that allow the fitness ball (20) to independently rotate is illustrated and are disposed within cover (12, 13). Each cover (12, 13) can independently rotate 360 degrees. Opposing ball bearings (41, 43) are disposed between the handles (10, 11) on the opposing sides of the shaft (35). In operation as shown in FIGS. 8 and 8A, the user grasp the handles (10, 11), and he can rotate the fitness ball (20) by turning the handles (10, 11). The ball bearings (41, 43) facilitate the rotation of the fitness ball (20) while decreasing friction.

Figure 7:
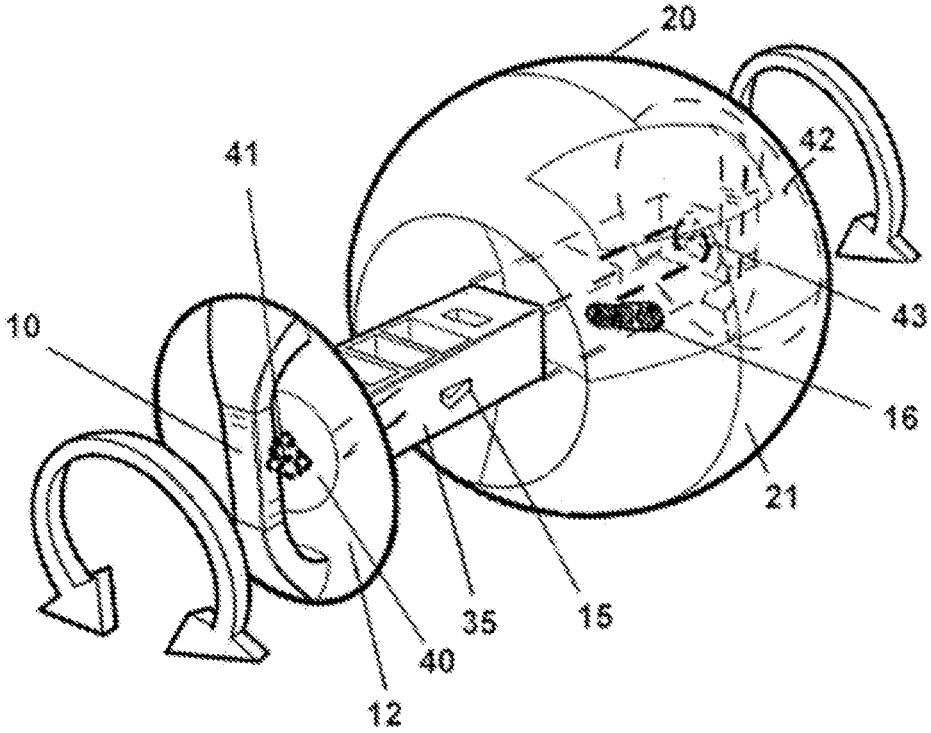
FIG. 7 is a perspective view of an alternative embodiment of the fitness ball with the rod for stabilization.
Figure 7A:
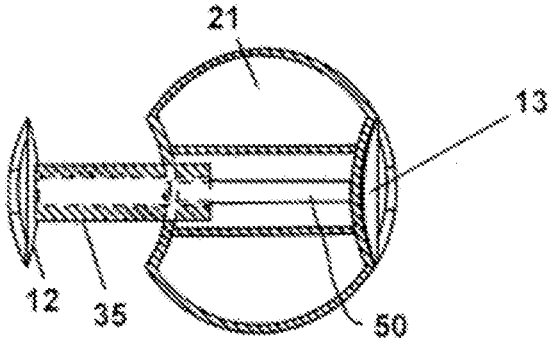
FIG. 7A is a cross-sectional view of the invention.
Figure 7B:
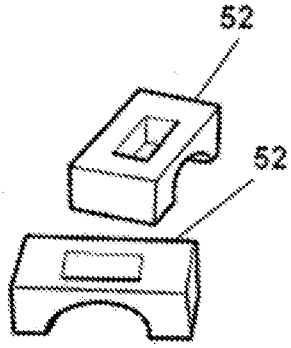
FIG. 7B is the cut away view of the weight.

Referring to FIGS. 7, 7A, and 7B, an alternative embodiment of the present invention is illustrated. A rod (50) is provided to stabilize the fitness ball (20) specifically when larger weights (52) are used. The rod (50) is tubular in structure and is permanently attached to cover (13). In the alternative embodiment, the interior shaft (35) is still included, but has some modifications. In the alternative embodiment, the shaft (35) is modified to slide over and engage with the rod (50). The underside of the shaft (35) has an arc which allows the shaft (35) to engage with the rod (50). FIG. 7B illustrates the underside of each weight (52) also has an arc, so it can fit into the modified shaft (35). The weights (52) have a rectangular depression on the top, and a handle (51) is attached to the depression. The handle (51) allows the user to pick the weight (52) up. Handle (51) can also be used in the weights in FIG. 1 as illustrated in FIG. 1C.

Figure 9:
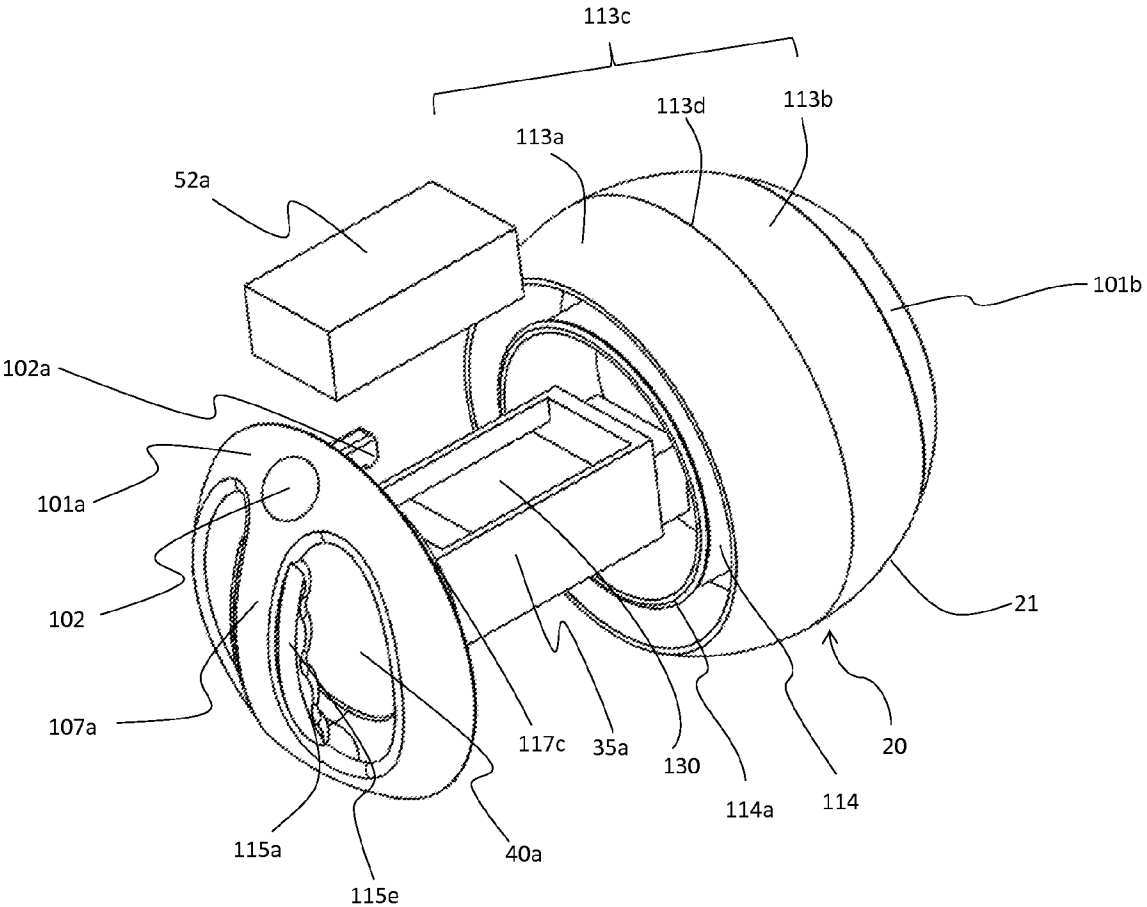
FIG. 9 is a perspective view of another embodiment of the present invention showing the release button, release button hook, recessed lip, recessed lip indented area, shaft, and compartment to receive a weight.

Referring now to FIG. 9, another embodiment of the present invention is shown. FIG. 9 shows fitness ball (20), which comprises geometrical structure (21). In this embodiment, structure (21) is spherical, but can comprise of other geometric shapes. Left body half (113*a*) and right body half (113*b*) connect to form main body (113*c*) along connection line (113*d*). However, those of ordinary skill in the art would understand that main body (113*c*) could be made of a unitary construction. Connection line (113*d*) wraps around or circumscribes structure (21). Structure (21) comprises two opposing covers (101*a*, 101*b*). In this embodiment, covers (101*a*, 101*b*) are circular in nature. Covers (101*a*, 101*b*) connect to main body (113*c*) and are oriented opposing and parallel to each other. The rear of cover (101*b*) contains a recessed area (not shown) to allow the recessed area to connect to right body half (113*b*) via fastener materials such as screws, locking mechanisms, living hinge, bolts, or adhesives, as known in the art, in a permanent or non-removable manner, but still allowing for cover (101*b*) to be rotated 360 degrees clockwise or counter clockwise as will be described below. Covers (101*a*, 101*b*) further comprise handles (107*a*, 107*b*), which are integrated on the outer surface of covers (101*a*, 101*b*) as a single unit, providing for more rigid covers (101*a*, 101*b*). Handles (107*a*, 107*b*) arc over recessed sections (40*a*, 42*a*) located in the center of the outer surfaces of covers (101*a*, 101*b*) and directly below handles (107*a*, 107*b*).

Handles (107*a*, 107*b*) comprise grips (115*a*, 115*b*). Grips (115*a*, 115*b*) are preferably made of silicon, rubber, or any other material with a soft surface to allow the trainee to firmly grasp handles (107*a*, 107*b*) to minimize slippage and also to provide comfort. Grips (115*a*, 115*b*) further comprise grip grooves (115*e*). Grip grooves (115*e*) have grooves that ergonomically conform to the trainee's fingers when grasping handles (107*a*, 107*b*) for comfort. Recessed sections (40*a*, 42*a*) create sufficient space to allow the trainee's fingers to wrap around handles (107*a*, 107*b*) in order to firmly grasp them to facilitate the lifting of fitness ball (20). Covers (101*a*, 101*b*) can be rotated 360 degrees clockwise or counter clockwise.

Figure 14:
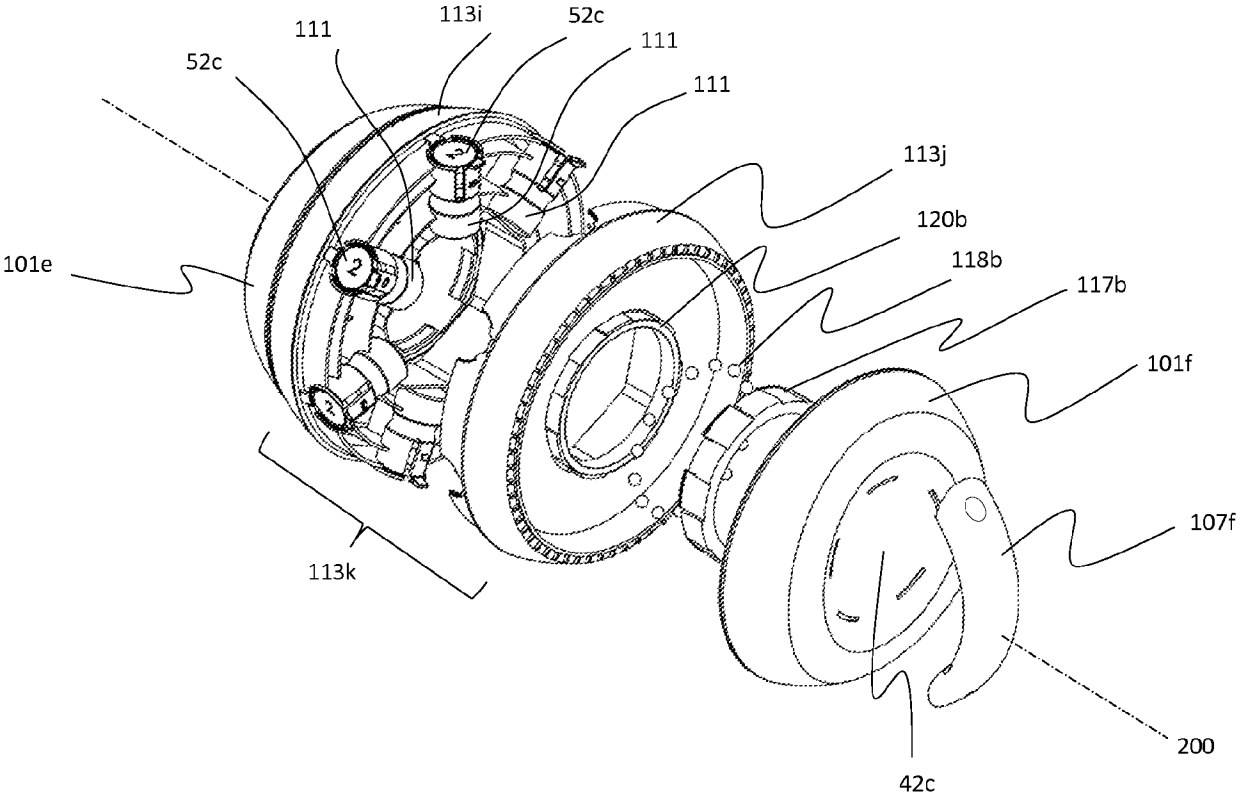
FIG. 14 is a partial exploded perspective view of another embodiment of the present invention.

The 360 degree rotation clockwise or counter clockwise of cover (101*b*) is made possible due to a similar design of cover (1010 shown in FIG. 14. As shown in FIG. 14, rolling bearing case (117*b*) contains a set of rolling bearings (118*b*). Rolling bearing case (117*b*) connects to rolling bearing case receiving area (120*b*), which is located on the outer surface of right body half (113*j*). Rolling bearings (118*b*) facilitate the 360 degree clockwise or counterclockwise rotation of cover (1010, such bearing mechanisms being well known in the art. Referring back to FIG. 9, cover (101*b*) also features a set of rolling bearings (not shown) connected to a rolling bearing case receiving area (not shown) located on the outer surfaces of right body half (113*b*) of main body (113*c*). Rolling bearings facilitate the 360 degree clockwise or counterclockwise rotation of cover (101*b*), such bearing mechanisms being well known in the art Still referring to FIG. 9, the 360 degree rotation clockwise or counter clockwise of cover (101*a*) is made possible through use of rolling bearings. One end of shaft (35*a*) comprises rolling bearing receiving area (not shown). The interior side of cover (101*a*) contains rolling bearing case (117*c*), which contains a set of rolling bearings (not shown). Rolling bearing case (117*c*) connects to rolling bearing case receiving area (not shown) located on one end of shaft (35*a*). Rolling bearings facilitate the 360 degree clockwise or counterclockwise rotation of cover (101*a*), such bearing mechanisms being well known in the art.

The ability of covers (101*a*, 101*b*) to rotate alleviates stress on the wrists when lifting or holding fitness ball (20), allowing for a more firm grip.

Still referring to FIG. 9, and as described above, one end of shaft (35*a*), which is connected to rolling bearing case receiving area (not shown), is attached to rolling bearing case (117*c*) located on the interior of cover (101*a*). Cover (101*a*) further comprises a spring-loaded, release button (102) located on the outside surface of cover (101*a*) as shown. The opposite end of release button (102) comprises release button hook (102*a*). One end of release button hook (102*a*) comprises a lip or ledge that extends downwardly in the shape of a hook. Structure (21) of fitness ball (20) features a cylindrical-shaped recessed lip (114) found on the interior portion of structure (21). Recessed lip (114) is hollow in its central area to allow room for shaft (35*a*) to slide into structure (21) when fitness ball (20) is being used for training purposes. Recessed lip (114) further comprises recessed lip indented area (114*a*) for engaging and disengaging with release button hook (102*a*). Recessed lip indented area (114*a*) is an indented area that is located along the entire circumference of recessed lip (114) and shaped so that it engages with release button hook (102*a*). When release button (102) is pressed, release button hook (102*a*) is moved laterally and lifts upwardly so that the lip or ledge of release button hook (102*a*) disengages its lock or hold of recessed lip indented area (114*a*). The result of this disengagement or unlocking of recessed lip indented area (114*a*) by pressing on release button (102) is that cover (101*a*) and shaft (35*a*) are allowed to simultaneously separate away from main body (113*c*) to allow the trainee to access shaft (35*a*) and compartment (130) in order to add or remove weight (52*a*). Thus, cover (101*a*) is characterized as being removable whenever release button (102) is pressed.

In this embodiment, shaft (35*a*) is rectangular in structure and shaft (35*a*) comprises one compartment (130). Compartment (130) is aligned along the longitudinal axis of shaft (35*a*). Compartment (130) is a recessed area of shaft (35*a*) designed to receive one or more weights (52*a*) of various sizes, shapes, and weight amount (52*d*) (not shown). In the embodiment shown in FIG. 9, shaft (35*a*) comprises one compartment (130). Preferably, the shape of weight (52*a*) is designed so that it fits snuggly into compartment (130) with minimal or no movement, so that only one weight (52*a*) can be placed inside a single compartment (130). However, depending on the size and shape of the weight, it may be possible to place more than one weight (52*a*) inside a single compartment (130). After weight (52*a*) is placed into compartment (130), shaft (35*a*) slides back into main body (113*c*) and locks into place.

Optionally, weight (52*a*) can have a rectangular depression on the top and weight handle (51*a*) (not pictured) that is attached to the depression. Weight handle (51*a*) (not pictured) allows the user to pick weight (52*a*) up to remove it from compartment (130). For example, weight (52*a*) shown in FIG. 9 could comprise weight handle (51*a*), not shown.

By using weight (52*a*) that can be inserted into or removed from compartment (130), the trainee is given the flexibility to control the overall weight of fitness ball (20), by either increasing or decreasing the amount of weight of weights (52*a*) for placement into compartment (130). Controlling the overall weight of fitness ball (20) is beneficial for several reasons. For example, if the trainee desires to exercise with a heavier fitness ball (20), the trainee can simply substitute an existing weight (52*a*) with a weight (52*a*) that is of a heavier weight. Similarly, if the trainee desires to exercise with a lighter fitness ball (20), the trainee can simply substitute an existing weight (52*a*) with a weight (52) that is of a lighter weight, or can remove all removable weight(s). The adjustable weight feature of fitness ball (20) eliminates the hassle of having to locate and use an entirely different fitness ball (20) in order to train with heavier or lighter overall weight. In addition, the present invention provides economic benefits to the trainee. The trainee would only have to purchase one or two fitness balls (20) and a set of weights (52*a*) of varying amounts of weight in order to benefit from having a wide range of weights to exercise with. The present invention gives the trainee the flexibility to change the overall weight of the fitness ball (20) quickly and easily as desired. Therefore, the present invention is economically cheaper to use as a training device when compared to fitness balls (20) that have a set or predetermined amount of weight, wherein the trainee must purchase multiple fitness balls, which can become quite expensive, in order to enjoy the wide range of varying and adjustable amounts of weight that are made possible with the present invention. However, it is envisioned that the overall weight of the fitness ball (20) without any added weights (52) could be varied to provide a range of adjustable weighted fitness balls (20).

Figure 10:
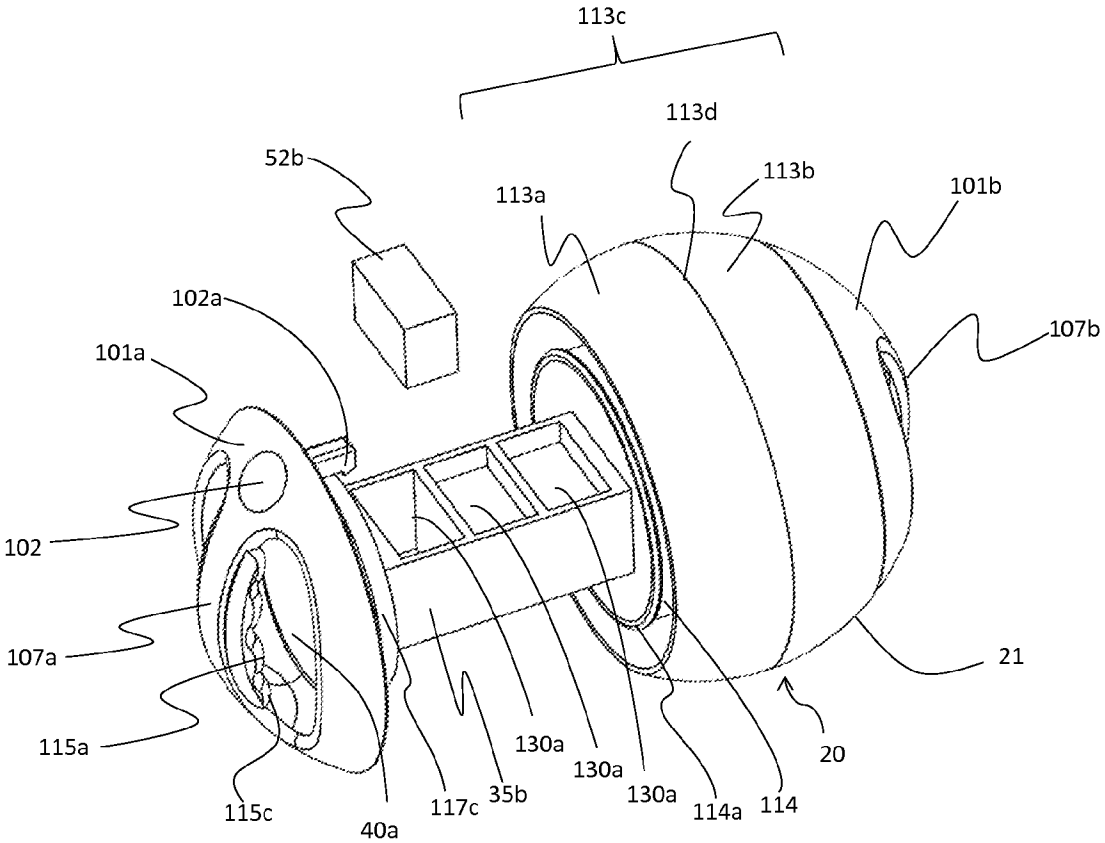
FIG. 10 is a perspective view of another embodiment of the present invention showing the release button, release button hook, recessed lip, recessed lip indented area, shaft, and three compartments to receive up to three weights.

Referring now to FIG. 10, is another embodiment of the present invention. This embodiment is similar to the embodiment shown in FIG. 9. However, in this embodiment, shaft (35*b*) comprises three compartments (130*a*). Each compartment (130*a*) is capable of receiving weight(s) (52*b*). Other embodiments (not shown) of shaft (35*b*) could comprise two compartments, four compartments, five compartments, and so forth.

Figure 11:
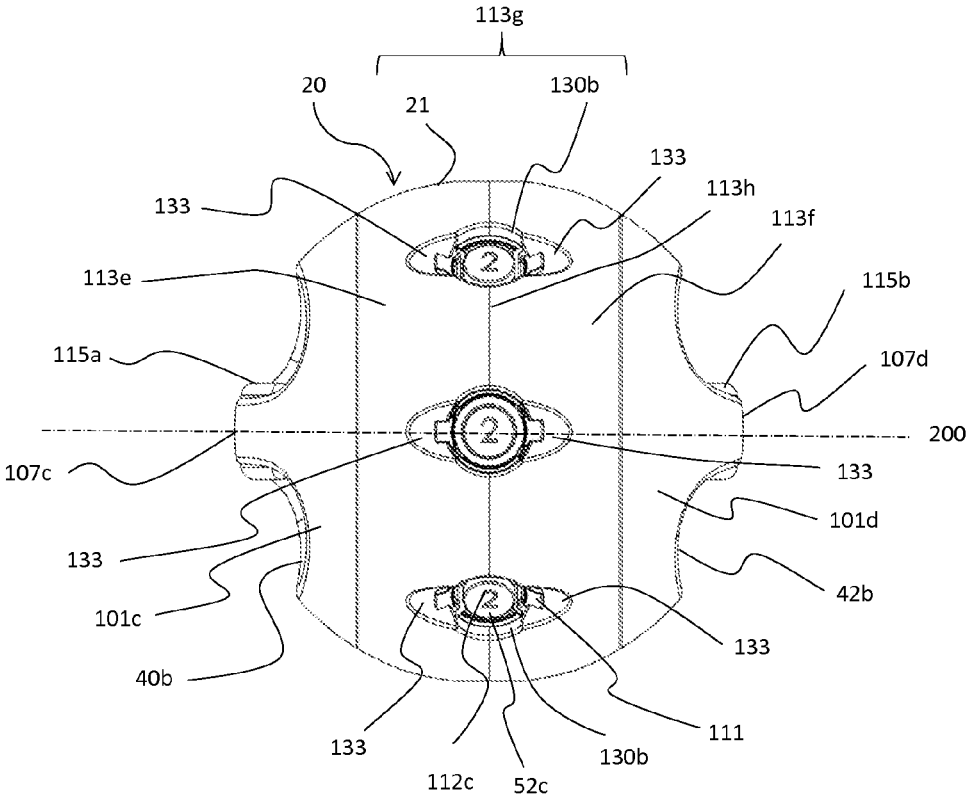
FIG. 11 is a front view of another embodiment of the present invention showing weights inserted into weight cartridges, which are then inserted into compartments located on the outer surface of the main body of the fitness ball.

Referring now to FIG. 11 shows another embodiment of the present invention. FIG. 11 shows fitness ball (20), which comprises structure (21). In this embodiment, structure (21) is spherical, but can comprise other geometric shapes. Structure (21) comprises left body half (113*e*) and right body half (1130, which connect together to form main body (113*g*) along connection line (113*h*). However, those of ordinary skill in the art would understand that main body (113*g*) could be made of a unitary construction. Connection line (113*h*) wraps around or circumscribes structure (21). When main body (113*g*) is formed, a plurality of compartments (130*b*) are formed and located on the outer surface of main body (113*g*), wherein compartments (130*b*) extend radially about axis line (200) from the center of structure (21). In the embodiment shown in FIG. 11, each compartment (130*b*) is evenly spaced apart from an adjacent compartment (130*b*) and is centrally located about connection line (113*h*). Compartment (130*b*) is an aperture or cavity that is capable of receiving weight cartridge (111), preferably with weight (52*c*) inserted therein. Compartment (130*b*) comprises compartment finger recessed area (133), which is a recessed area to allow the trainee's fingers to access weight cartridge (111) and weight (52*c*) in order to insert or remove weight cartridge (111) containing weight (52*c*) to adjust the overall weight of structure (21). Weight (52*c*) is inserted into weight cartridge (111), which is inserted into compartment (130*b*) as shown.

Cover (101*c*) connects to the outer surface of left body half (113*e*) and cover (101*d*) connects to the outer surface of right body half (113*h*). In the embodiment shown in FIG. 11, covers (101*c*, 101*d*) are circular in nature. Covers (101*c*, 101*d*) can rotate 360 degrees clockwise or counterclockwise. Covers (101*c*, 101*d*) further comprise handles (107*c*, 107*d*), which are integrated with covers (101*c*, 101*d*) as a single unit, which provides for more rigid covers (101*c*, 101*d*). Handles (107*c*, 107*d*) comprise grips (115*a*, 115*b*). Grips (115*a*, 115*b*) are preferably made of silicon, rubber, or any other material with soft surface to allow the trainee to firmly grasp handles (107*c*, 107*d*) to minimize slippage and to provide comfort. Grips (115*a*, 115*b*) further comprise grip grooves (115*e*). Grip grooves (115*e*) have grooves that ergonomically conform to the trainee's fingers when grasping handles (107*c*, 107*d*) for comfort. Handles (107*c*, 107*d*) arc over recessed sections (40*b*, 42*b*), which are located in the center of the outer surface of covers (101*c*, 101*d*) and directly below handles (107*c*, 107*d*). Recessed sections (40*b*, 42*b*) create sufficient space to allow the trainee's fingers to wrap around handles (107*c*, 107*d*) in order to firmly grasp them to facilitate the lifting of fitness ball (20).

In the embodiment shown in FIG. 11, compartments (130*b*) are preferably all located at the center along connection line (113*h*) to provide balance to structure (21) when weight cartridges (111) and weights (52*c*) are inserted into compartments (130*b*). However, in other embodiments (not shown), the location of compartments (130*b*) are staggered on the outer surface of left body half (113*e*) and right body half (113*f*)).

Still referring to FIG. 11, weight (52*c*) is inserted into weight cartridge (111). Weight (52*c*) may comprise a numeral printed on it showing weight amount (112*c*). Weight amount (112*c*) is the amount of weight corresponding to weight (52*c*), and can be for example, 1 lb., 2 lb., 3 lb., 4 lb., 5 lb., and so forth. One weight cartridge (111), preferably with weight (52*c*) inserted therein, can be inserted or placed into one compartment (130*b*) to increase the overall weight of fitness ball (20). However, multiple weight cartridges (111), containing weights (52*c*), can be inserted into multiple compartments (130*b*) to increase the overall weight of fitness ball (20). For example, as shown in FIG. 11, three weight cartridges (111) containing three weights (52*c*) are shown inserted into three compartments (130*b*), there being other available compartments located on the back side (not shown). Each weight (52*c*) has weight amount (112*c*) of 2 lbs. as shown. Further, the present invention does not require all available compartments (130*b*) to contain weight cartridges (111) with weights (52*c*). Further, the present invention does not need to contain any weight cartridges (111) or weights (52*c*) in order to train with fitness ball (20).

Figure 12:
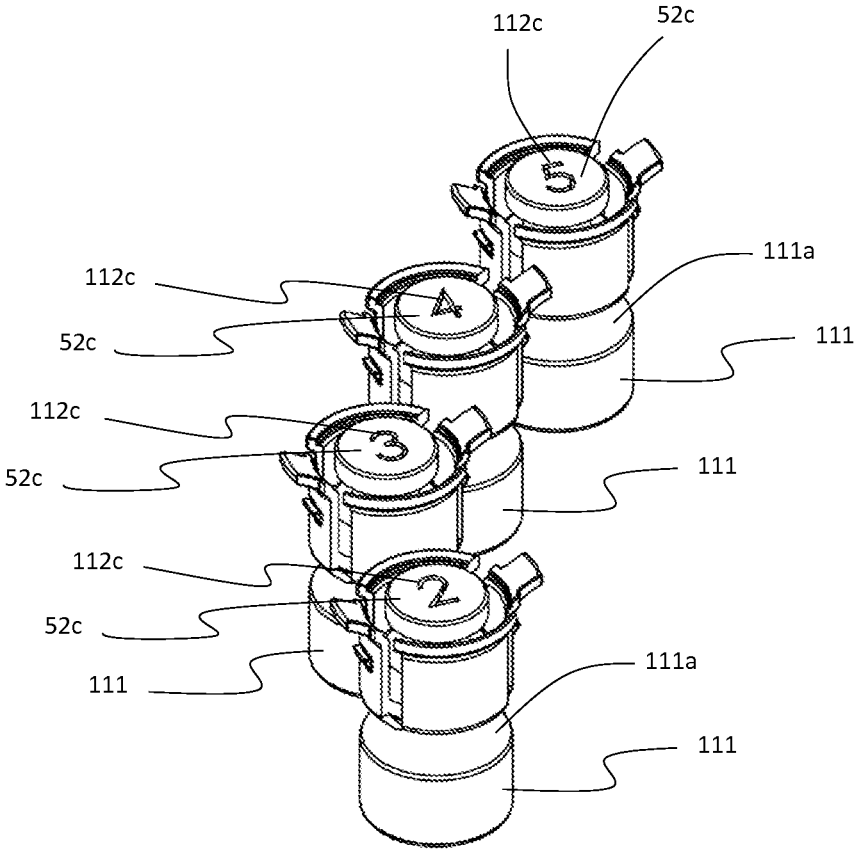
FIG. 12 is a perspective view of different weight amounts of weights inserted inside weight cartridges.

FIG. 12 illustrates a set of weights (52*c*) that comprise weight amount (112*c*) of different amounts of weight. As shown, weights (52*c*) comprise various weight amounts (112*c*), such as 2 lb., 3 lb., 4 lb., and 5 lb. However, other weight amounts (112*c*) of weights (52*c*) may be employed. As shown in FIG. 12, one weight (52*c*) is inserted into one weight cartridge (111).

Figure 13:
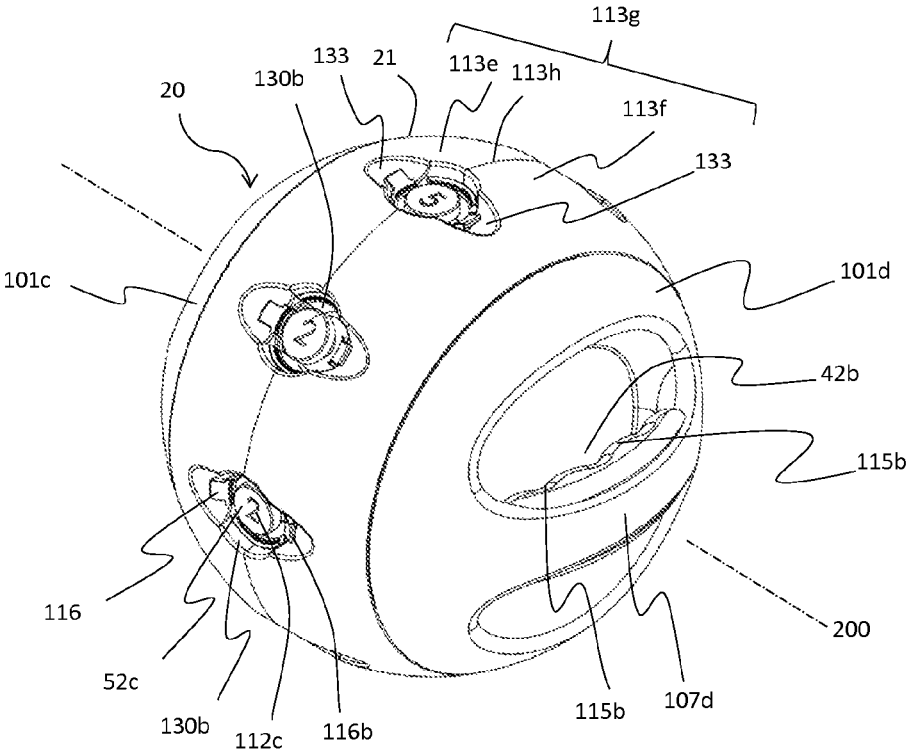
FIG. 13 is a perspective view of the embodiment of the present invention shown in FIG. 11.

FIG. 13 shows a perspective view of the embodiment of the present invention shown in FIG. 11. As shown in FIG. 13, fitness ball (20) comprises structure (21), whereby structure (21) is spherical. Left body half (113*e*) and right body half (1130 are connected together to form main body (113*g*) about connection line (113*h*). However, those of ordinary skill in the art would understand that main body (113*g*) could be made of a unitary construction. Connection line (113*h*) wraps around or circumscribes structure (21). When main body (113*g*) is formed, a plurality of compartments (130*b*) are formed and located on the outer surface of main body (113*g*), wherein compartments (130*b*) extend radially about axis line (200) from the center of structure (21). In the embodiment shown in FIG. 13, each compartment (130*b*) is evenly spaced apart from an adjacent compartment (130*b*) and is centrally located about connection line (113*h*). Weight (52*c*) is inserted into weight cartridge (111). As shown, each weight (52*c*) may have printed on it, weight amount (112*c*), which corresponds to the amount of weight for that weight (52*c*). Compartment (130*b*) comprises compartment finger recessed area (133), which is a recessed area to allow the trainee's fingers to access weight cartridges (111) and weights (52*c*) in order to insert or remove weight cartridges (111) and weights (52*c*) to adjust the overall weight of structure (21).

In the embodiment shown in FIG. 13, compartments (130*b*) are preferably of a sufficient depth to allow weight cartridges (111) to be inserted deep enough into compartments (130*b*) so that weights (52*c*) and weight cartridges (111) are located below the outer surface of main body (113*g*) of structure (21). Stated another way, compartments (130*b*) extend radially about axis line (200) from the center of structure (21) such that weight cartridge (111) and weight (52*c*) are located below the outer surface of main body (113*g*) of structure (21). This configuration is beneficial because it allows structure (21) to be easily pushed, pulled, or rolled on the ground with minimal obstruction. In other embodiments (not shown), compartments (130*b*) are of a sufficient depth to allow weight (52*c*) and weight cartridge (111) to be inserted so that they are flush with the outer surface of main body (113*g*) of structure (21), which similarly, allows structure (21) to be easily pushed, pulled, or rolled on the ground with minimal obstruction during training. Also shown in FIG. 13, are covers (101*c*, 101*d*), which comprise handles (107*c*, 107*d*). Handles (107*c*, 107*d*) arc over recessed sections (40*b*, 42*b*), which are located in the center of the outer surface of covers (101*c*, 101*d*) and directly below handles (107*c*, 107*d*).

Recessed sections (40*b*, 42*b*) create sufficient space to allow the trainee's fingers to wrap around handles (107*c*, 107*d*) in order to firmly grasp them to facilitate the lifting of fitness ball (20). Handles (107*c*, 107*d*) further comprise grips (115*a*, 115*b*). Grips (115*a*, 115*b*) comprise grip grooves (115*e*). Cover (101*c*) connects to left body half (113*a*) and cover (101*d*) connects to right body half (101*d*) as shown, whereby covers (101*c*, 101*d*) can rotate 360 degrees clockwise or counterclockwise.

FIG. 14 shows a partial exploded view of another embodiment of the present invention. As shown in FIG. 14, fitness ball (20) comprises structure (21), whereby structure (21) is spherical. In this embodiment, handles (107*e*, 107*f*) can be separately attached to covers (101*e*, 101*f*) using fastener materials such as screws or bolts, instead of integrated into covers as a solidly constructed unit as shown in FIGS. 9-11, 13, 15, 16-17, 22-23, 26-39, for example. In this embodiment, handles (107*e*, 1070 arc over recessed sections (40*c*, 42*c*), which are located in the center of the outer surface of covers (101*e*, 1010 and directly below handles (107*e*, 1070. Recessed sections (40*c*, 42*c*) create sufficient space to allow the trainee's fingers to wrap around handles (107*e*, 1070 in order to firmly grasp them to facilitate the lifting of fitness ball (20). Handles (107*e*, 1070 are fixably attached to covers (101*e*, 1010. The interior surfaces of covers (101*e*, 1010 connect to rolling bearing cases (117*a*, 117*b*). Rolling bearing cases (117*a*, 117*b*) contain a set of rolling bearings (118*a*, 118*b*). Rolling bearings (118*a*, 118*b*) facilitate the 360 degree clockwise or counterclockwise rotation of covers (101*e*, 1010, such bearing mechanisms being well known in the art. Rolling bearing cases (117*a*, 117*b*) connect to rolling bearing case receiving areas (120*a*, 120*b*), which are located on the outer surfaces of left and right body halves (113*i*, 113*j*). Left body half (113*i*) connects to right body half (113*j*) to form main body (113*k*) along connection line (113*l*) (not shown). However, those of ordinary skill in the art would understand that main body (113*k*) could be made of a unitary construction.

Connection line (113*l*) (not shown) wraps around or circumscribes structure (21). Covers (101*e*, 1010 also connect to the outer surfaces of left and right body halves (113*i*, 113*j*). In this exploded view, weight (52*c*) is shown inserted into weight cartridge (111). Weight cartridges (111) are inserted into one or more compartments (130*c*). In this embodiment, multiple (e.g., 6-8) compartments (130*c*) may extend radially about axis line (200) from the center of structure (21) and each compartment (130*c*) is spaced evenly apart from an adjacent compartment (130*b*) on the outer surface of main body (113*k*) about connection line (113*l*) (not shown). The number of compartments can be varied. In this embodiment, compartments (130*c*) are of a sufficient depth to allow weight cartridges (111) to be inserted deep enough into compartments (130*c*) so that weights (52*c*) and weight cartridges (111) are located below the outer surface of main body (113*k*) of structure (21).

Figure 15:
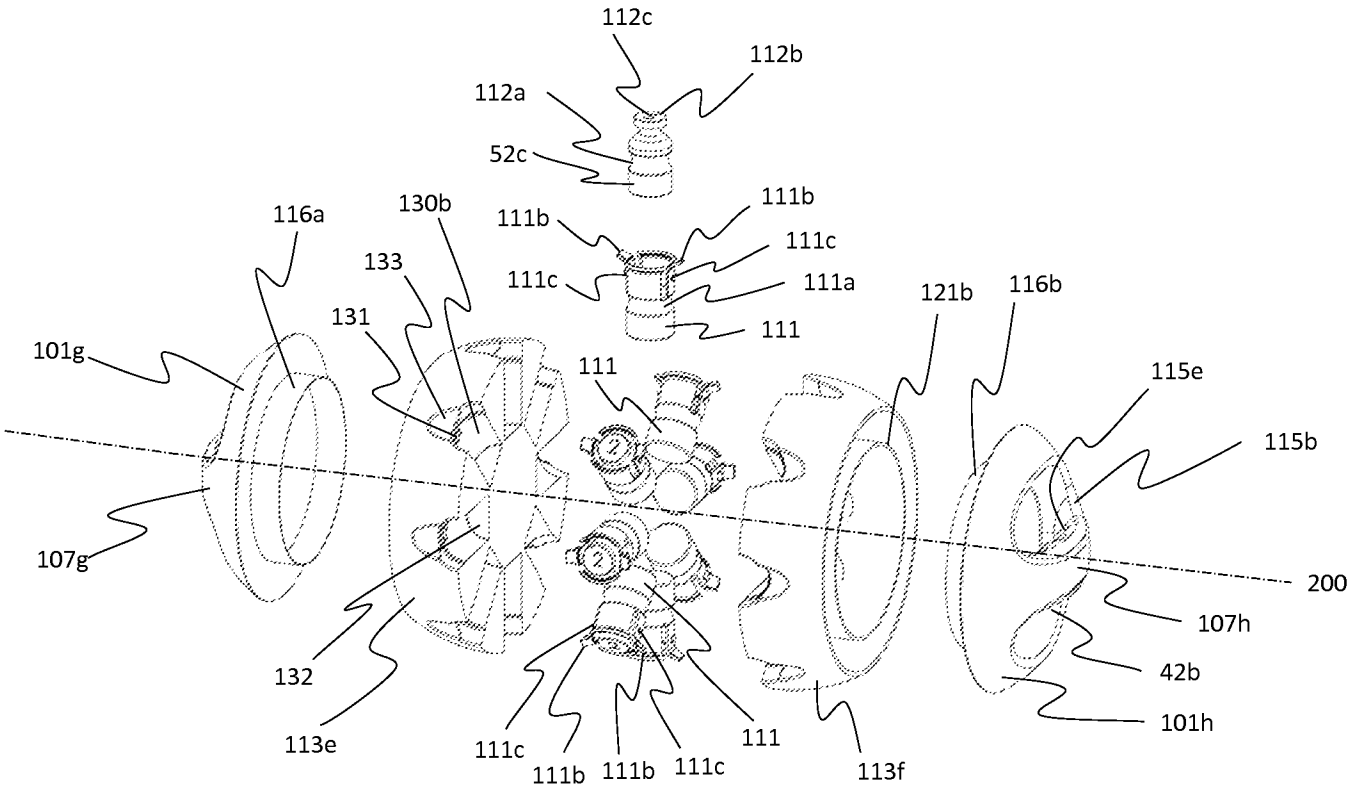
FIG. 15 is an exploded perspective view of another embodiment of the present invention where weights are inserted into weight cartridges, which are then inserted into compartments located on the outer surface of the main body of the fitness ball, comprising covers, handles, and grips.

FIG. 15 is an exploded view of another embodiment of the present invention. If the components of FIG. 15 are assembled, fitness ball (20) comprises structure (21), whereby structure (21) is spherical. In this embodiment, handles (107*g*, 107*h*) are integrated with covers (101*g*, 101*h*) as a single unit, which provides for more rigid handles (107*g*, 107*h*). Handles (107*g*, 107*h*) arc over recessed sections (40*b*, 42*b*), which are located in the center of the outer surface of covers (101*g*, 101*h*) and directly below handles (107*g*, 107*h*). Recessed sections (40*b*, 42*b*) create sufficient space to allow the trainee's fingers to wrap around handles (107*g*, 107*h*) in order to firmly grasp them to facilitate the lifting of fitness ball (20). Handles (107*g*, 107*h*) further comprise grips (115*a*, 115*b*), which are preferable made of silicon, rubber, or other soft material that allow the trainee to firmly grasp handles (107*g*, 107*h*) to minimize slippage and to provide comfort. Grips (115*a*, 115*b*) comprise grip grooves (115*e*). Grip grooves (115*e*) have grooves that ergonomically conform to the trainee's fingers when grasping handles (107*g*, 107*h*) for comfort.

Rolling bearing assemblies (116*a*, 116*b*) are connected to the interior surfaces of covers (101*g*, 101*h*). Rolling bearing assemblies (116*a*, 116*b*) are circular in shape as shown. The outer surfaces of left and right body halves (113*e*, 113*f*) comprise rolling bearing assembly receiving areas (121*a*, 121*b*). Rolling bearing assemblies (116*a*, 116*b*) connect to rolling bearing assembly receiving areas (121*a*, 121*b*), so that covers (101*g*, 101*h*) are attached to the outer surfaces of left and right body halves (113*e*, 1130. Once attached, covers (101*g*, 101*h*) are free to rotate 360 degrees clockwise or counterclockwise as facilitated by rolling bearing assemblies (116*a*, 116*b*).

Still referring to FIG. 15, weight (52*c*) comprises weight narrow body (112*a*) and weight grip (112*b*). Weight cartridge (111) comprises weight cartridge narrow body (111*a*), weight cartridge release ears (111*b*), and weight cartridge locking tabs (111*c*). Weight (52*c*) is inserted into weight cartridge (111) and stays secured in weight cartridge (111) via interference fit (also known as "press fit" or "friction fit") as is known in the art and discussed in more detail in connection with the descriptions for FIGS. 20-21. One weight cartridge (111) is inserted into one compartment (130*b*). A plurality of compartments (130*b*) are formed when left body half (113*e*) and right body half (113*f*) are connected to form main body (113*g*) about connection line (113*h*) (not shown). However, those of ordinary skill in the art would understand that main body (113*g*) could be made of a unitary construction. Connection line (113*h*) wraps around or circumscribes structure (21). Compartments (130*b*) extend radially about axis line (200) from the center of structure (21) so that compartments (130*b*) are located on the outer surface of main body (113*g*) about connection line (113*h*) (not shown). As shown in FIG. 15, each compartment (130*b*) further comprises compartment ledge (132), compartment recessed area (131), and compartment finger recessed area (133). Compartment ledge (132) is a substantially flat area that provides support to weight (52*c*) and weight cartridge (111). The embodiment shown in FIG. 15 comprises eight compartments (130*b*). However, other embodiments (not shown) may comprise more or less compartments (130*b*). Further, all compartments (130*b*) in this embodiment are aligned about line connection (113*h*) (not shown), which is formed when left and right body halves (113*e*, 1130 are connected. However, the location of compartments (130*b*) may vary in other embodiments. For example, compartments (130*b*) may be located in a staggered arrangement on left and right body halves (113*e*, 1130 or compartments (130*b*) may be located entirely on left half body (113*e*) or located entirely on right half body (1130.

Still referring to FIG. 15, compartment recessed area (131) is an internal area of compartment (130*b*) that is recessed, to receive entry of two opposing weight cartridge locking tabs (111*c*) when weight cartridge (111) is inserted into compartment (130*b*). The two opposing weight cartridge locking tabs (111*c*) lock into compartment recessed area (131), securing and locking weight cartridge (111) into compartment (130*b*).

Each weight cartridge (111) comprises two opposing weight cartridge release ears (111*b*). Weight cartridge release ears (111*b*) function in allowing the removal of weight cartridge (111), and also weight (52*c*), when weight cartridge release ears (111*b*) are squeezed together, which compresses the two opposing weight cartridge locking tabs (111*c*). When the two opposed weight cartridge locking tabs (111*c*) are compressed, they will exit compartment recessed area (131) and allow weight cartridge (111) and also weight (52*c*), to be lifted and removed from compartment (130*b*). This allows the trainee to adjust the overall weight of fitness ball (20) by adding or removing of weight cartridges (111) and weights (52*c*).

Figures 16, 17:
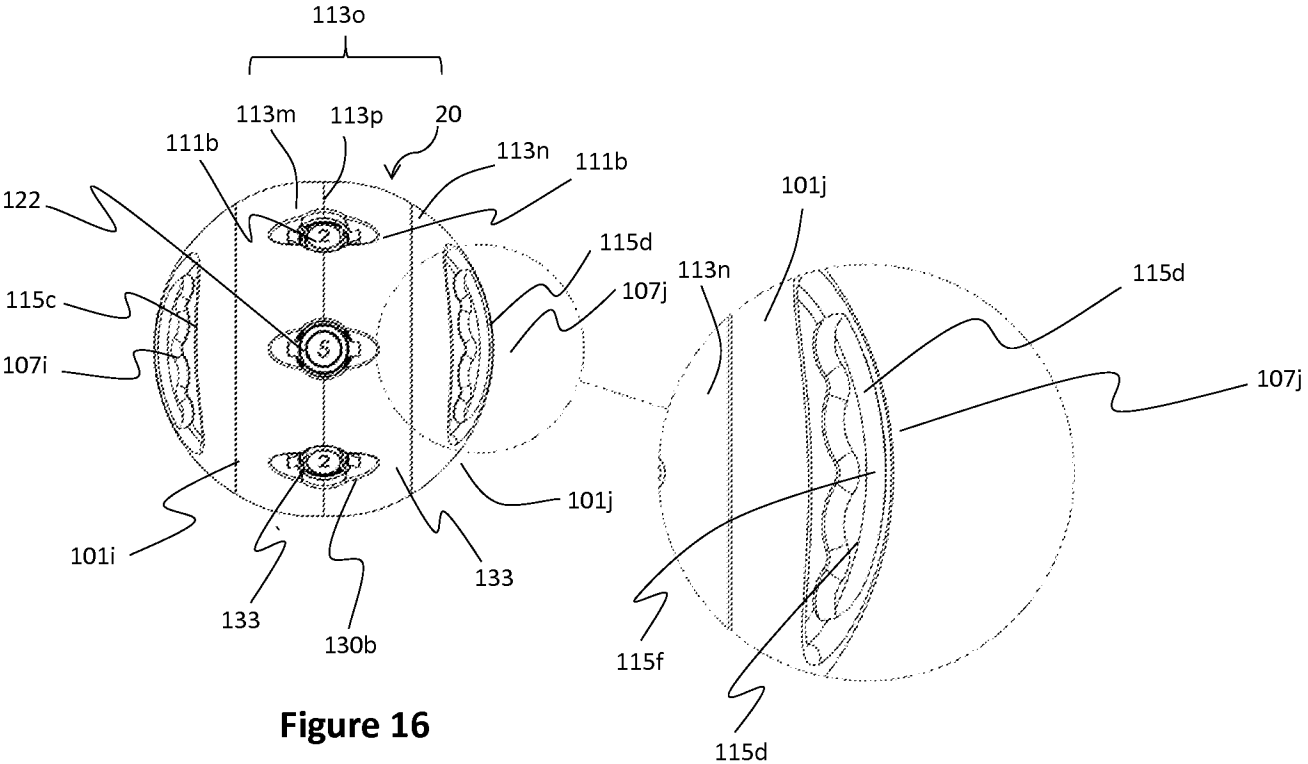
FIG. 16 is a front view of another embodiment of the present invention, which shows two opposing weight cartridge release ears and compartment finger recessed areas.
FIG. 17 is a close-up view of the embodiment shown in FIG. 16, which focuses on showing covers with handles, comprising grips and grip grooves.

FIG. 16 shows another embodiment of the present invention of a front view of fitness ball (20), comprising structure (21), and wherein structure (21) is spherical. In this embodiment, left body half (113*m*) connects to right body half (113*n*) to form main body (113*o*) about connection line (113*p*). Connection line (113*p*) wraps around or circumscribes structure (21). Like the embodiments shown in FIGS. 11, 13, 14 and 15, weight cartridges (111) are inserted into a plurality of compartments (130*b*). Compartments (130*b*) are located on the outer surface of main body (113*o*) along connection line (113*p*). However, those of ordinary skill in the art would understand that main body (113*o*) could be made of a unitary construction. Connection line (113*p*) wraps around or circumscribes structure (21). FIG. 16 further illustrates that compartments (130*b*) comprise compartment finger recessed areas (133). Finger recessed area (133) is a recessed area of compartment (130*b*), which provides room for fingers to grasp weight cartridge release ears (111*b*) to remove weight cartridge (111) and weight (52*c*). FIG. 16 also shows covers (101*i*, 101*j*), comprising handles (107*i*, 107*j*), connected to the left and right body halves (113*m*, 113*n*). Handles (107*i*, 107*j*) comprise grips (115*c*, 115*d*).

FIG. 17 shows a close-up view of the handle (107*j*) shown in FIG. 16. Handle (107*j*) comprises grip (115*d*). Grip (115*d*) is preferable made of silicon, rubber, or any other material with a soft surface to allow the trainee to grasp handle (107*j*) to minimize slippage and to provide comfort. Grip (115*d*) further comprises grip grooves (115*f*). Grip grooves (115*f*) have grooves that ergonomically conform to the trainee's fingers when grasping handle (107*j*) for comfort.

Figure 18:
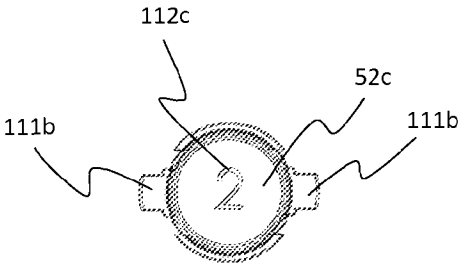
FIG. 18 is a top view of a weight, comprising a weight amount of 2 lbs, inserted into a weight cartridge.
Figure 19:
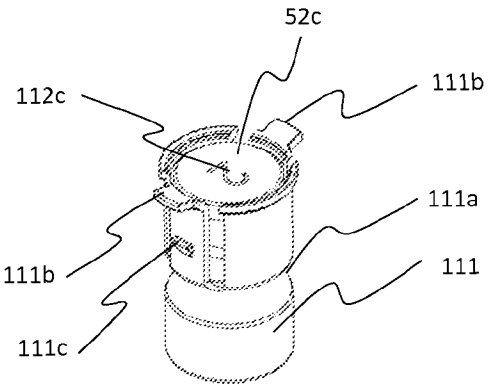
FIG. 19 is a perspective view of weight and weight cartridge shown in FIG. 18.
Figure 20:
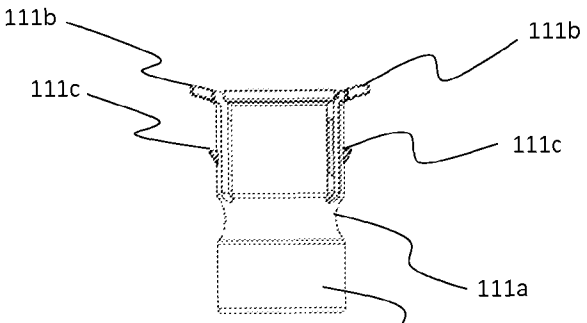
FIG. 20 is a front view of weight cartridge, comprising two opposing weight cartridge release ears, two opposing weight cartridge locking tabs, and weight cartridge narrow body.
Figure 21:
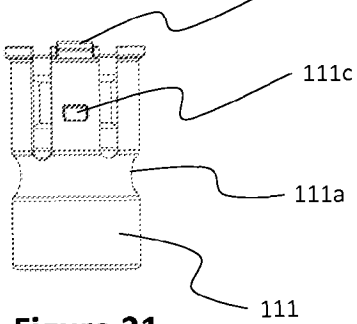
FIG. 21 is a side view of the weight cartridge shown in FIG. 20.

FIGS. 18-19 show top view and perspective views, respectively, of weight (52*c*) inserted into the weight cartridge (111) of FIG. 15. FIGS. 20-21 show a front view and side view, respectively, of weight cartridge (111) of FIG. 15 that does not contain weight (52*c*) inserted.

FIG. 18 shows a top view of the weight (52*c*) inserted into the weight cartridge (111) of FIG. 15. Optionally, weight (52*c*) can be labeled with a numeral designating weight amount (112*c*). As shown in FIG. 18, the numeral "2" indicates weight amount (112*c*) of 2 lbs. Weight cartridge (111) comprises slotted sleeve (shown here in cylindrical shape to receive the cylindrically-shaped weight (52*c*)). Slotted sleeve of weight cartridge (111) further comprises two opposing weight cartridge release ears (111*b*), whereby slotted sleeve is located between the two opposing weight cartridge release ears (111*b*) and is shaped appropriate to receive weight (52*c*).

FIG. 19 shows a perspective view of the weight (52*c*) inserted into the weight cartridge (111) of FIG. 18. From this view, slotted sleeve of weight cartridge (111) is located between the two opposing weight cartridge release ears (111*b*) along with weight cartridge locking tabs (111*c*) and weight cartridge narrow body (111*a*). Weight cartridge locking tabs (111*c*) are raised areas that enter and lock into compartment recessed area (130*b*) when weight cartridge (111) is inserted into compartment (130*b*) as shown in FIG. 15.

FIG. 20 shows a front view of weight cartridge (111), which comprises slotted sleeve (shown here in cylindrical shape to receive a cylindrically-shaped weight). Slotted sleeve of weight cartridge (111) further comprises two opposing weight cartridge release ears (111*b*), two opposing weight cartridge locking tabs (111*c*), and weight cartridge narrow body (111*a*). FIG. 21 shows a side view of the weight cartridge (111) shown in FIG. 20. Weight cartridge narrow body (111*a*) is an area wherein the middle sides of weight cartridge (111) are more narrow relative to the upper and lower sides of weight cartridge (111), whereby weight cartridge (111) is shaped like an hour-glass. As shown in FIG. 15, weight (52*c*) comprises weight narrow body (112*a*) and weight grip (112*b*). Weight narrow body (112*a*) is an area wherein the middle sides of weight (52*c*) are more narrow relative to the upper and lower sides of weigh (52*c*), whereby weight (52*c*) is shaped like an hour-glass. Through interference fit (also known as "press fit" or "friction fit") as known in the art, weight (52*c*) is locked into place upon its insertion inside weight cartridge (111) due to the hour-glass shape of weight (52*c*) conforming to the hour-glass shape of weight cartridge (111). Still referring to FIG. 15, weight grip (112*b*), which is located on the top portion of weight (52*c*), can be grasped and pulled with sufficient force to overcome the interference fit and release and remove weight (52*c*) from weight cartridge (111). Upon removal of weight (52*c*), the trainee can insert weight (52*c*) with a different weight amount (112*c*) into weight cartridge (111). Alternatively, the trainee can insert weight (52*c*) into any other weight cartridge (111) if desired.

Figure 23:
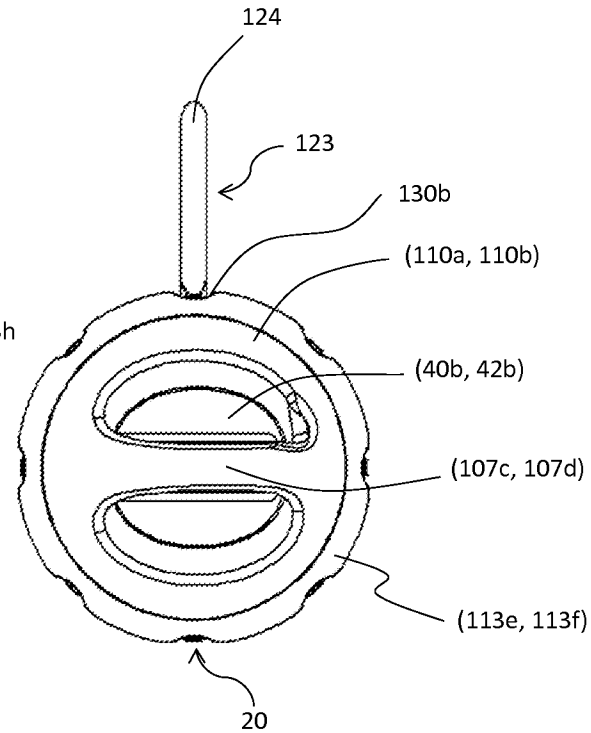
FIG. 23 shows a side view of the embodiment of the present invention shown in FIG. 22, showing kettle bell attachment inserted into one compartment.
Figure 22:
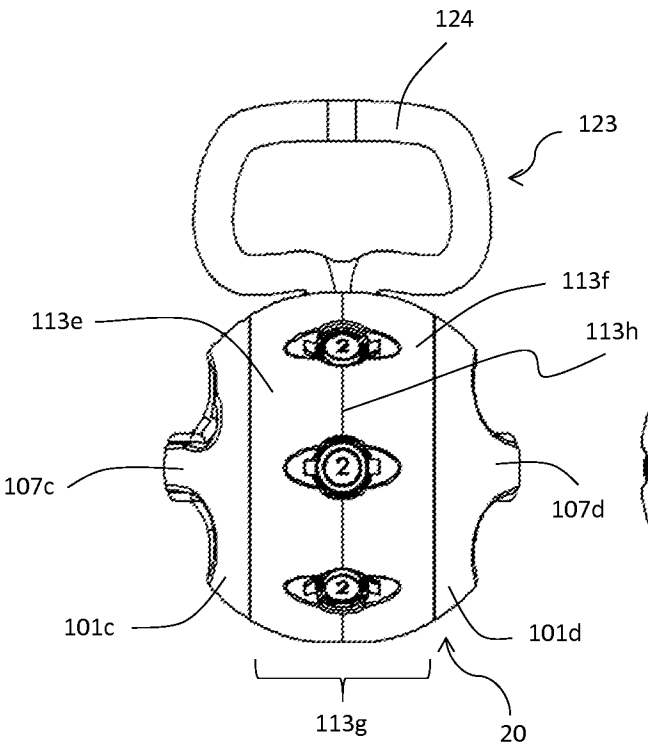
FIG. 22 is a front view of the embodiment of the invention shown in FIG. 11, showing kettle bell attachment inserted into one compartment.

FIG. 22 shows a front view of the embodiment of the present invention shown in FIG. 11, however, an optional accessory, known as kettle bell attachment (123), is inserted and attached to one compartment (130*b*). In FIG. 22, kettle bell attachment (123) comprises kettle bell handle (124), kettle bell handle bottom end (125) (not shown), and common base (126) (see FIGS. 24-25). Kettle bell handle bottom end (125) is fixedly connected and permanently attached to common base (126) (see FIGS. 24-25). Common base (126), with kettle bell handle bottom end (125) connected and permanently attached thereto, is inserted into one compartment (130*b*) to provide an alternative means to lift structure (21) at kettle bell handle (124). Kettle bell handle (124) is a portion of kettle bell attachment (123) that can be grasped by trainee to facilitate the lifting of structure (21), rather than grasping handles (107*c*, 107*d*) to lift structure (21). In one embodiment, kettle bell handle (124) is configured to accommodate being held by two hands at the same time, and in other embodiments, by one hand. FIG. 23 shows a side view of the embodiment shown in FIG. 22 with kettle bell attachment (123) connected to compartment (130*b*) as an optional accessory for use with structure (21). From this view, kettle bell attachment (123) is shown inserted into one of the multiple (here, e.g., eight) compartments (130*b*) of structure (21). Kettle bell handle (124) can further comprise ergonomically designed grips and grip shapes.

Figure 25:
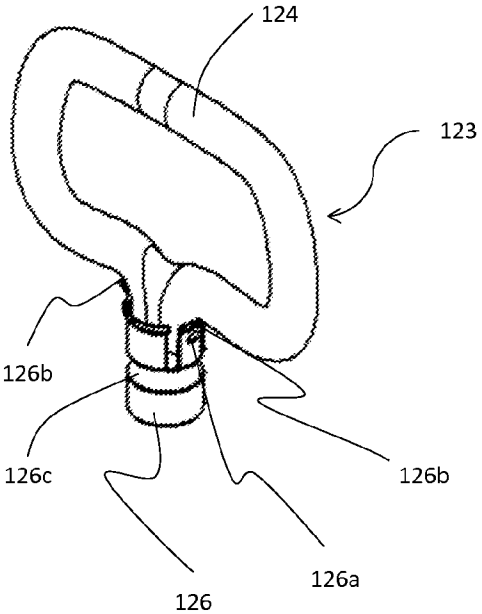
FIG. 25 is a perspective view of the kettle bell attachment and the common base shown in FIG. 25.
Figure 24:
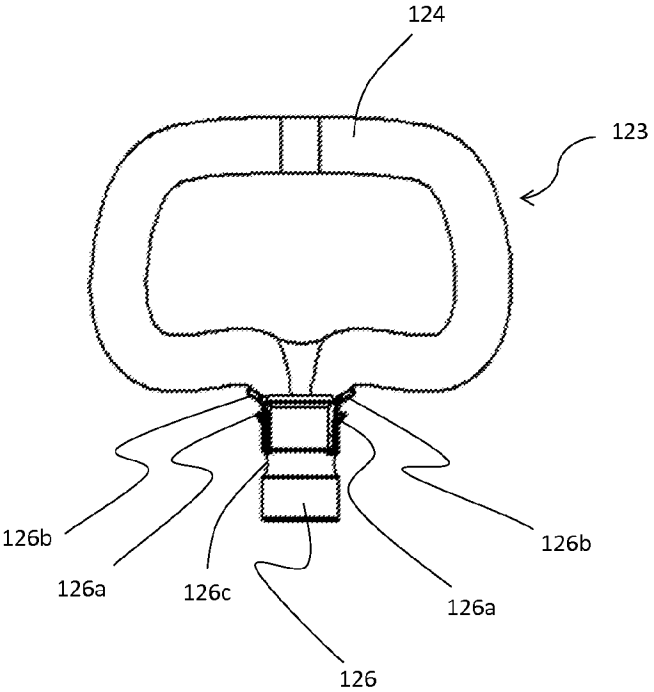
FIG. 24 shows kettle bell attachment connected to common base, which comprises common base locking tabs and common base release ears.
Figure 27:
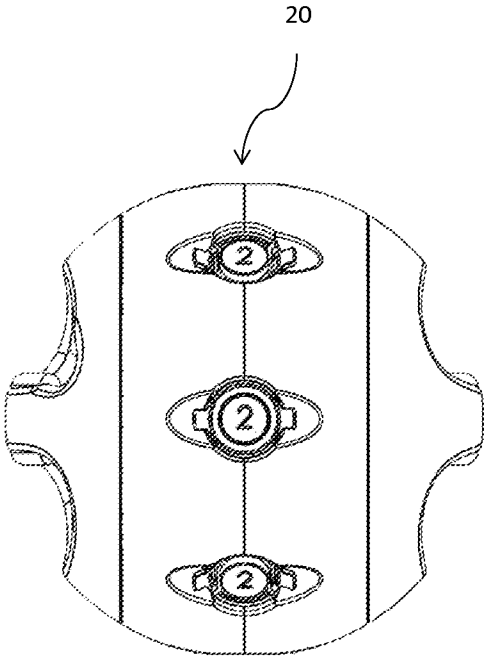
FIG. 27 is a rear view of the embodiment shown in FIG. 11.
Figure 26:
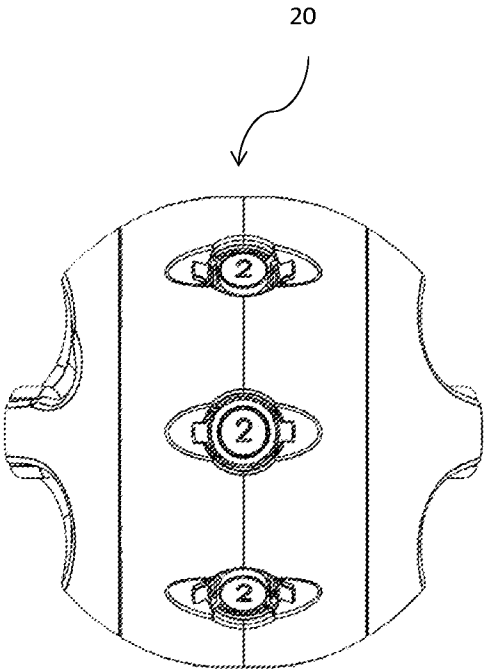
FIG. 26 is a front view of the embodiment shown in FIG. 11.
Figure 29:
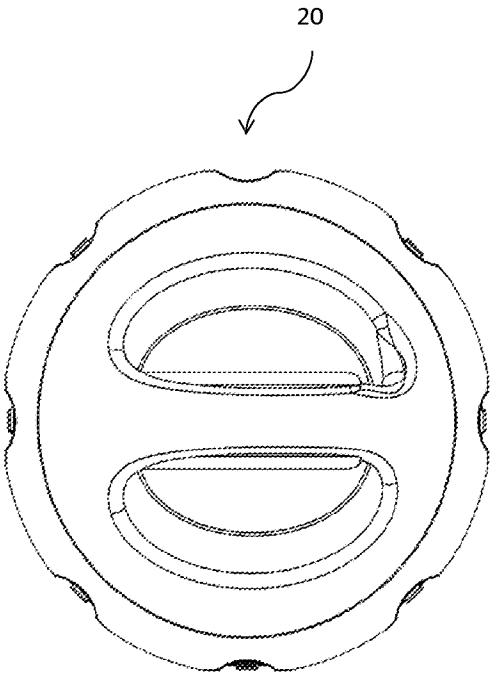
FIG. 29 is an opposite side view of the embodiment shown in FIG. 11.
Figure 28:
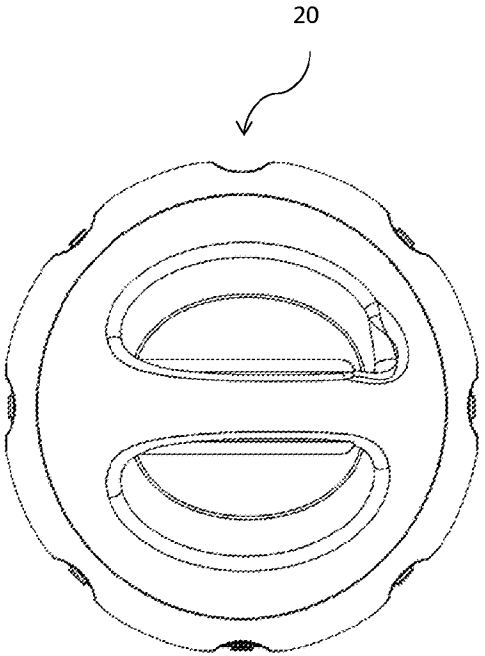
FIG. 28 is a side view of the embodiment shown in FIG. 11.
Figure 31:
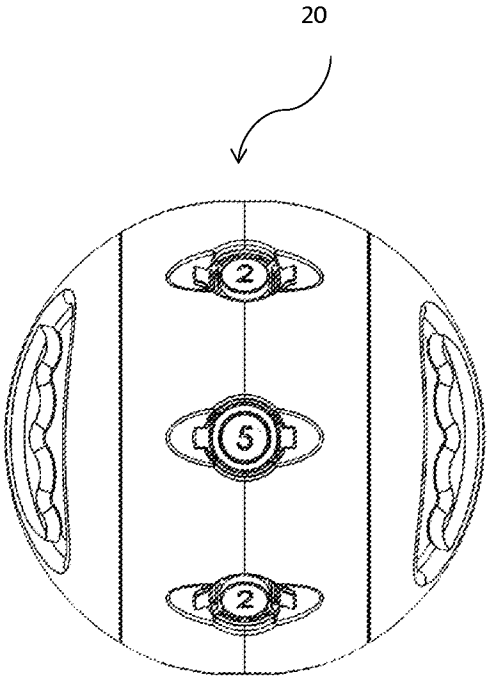
FIG. 31 is a bottom view of the embodiment shown in FIG. 11.
Figure 30:
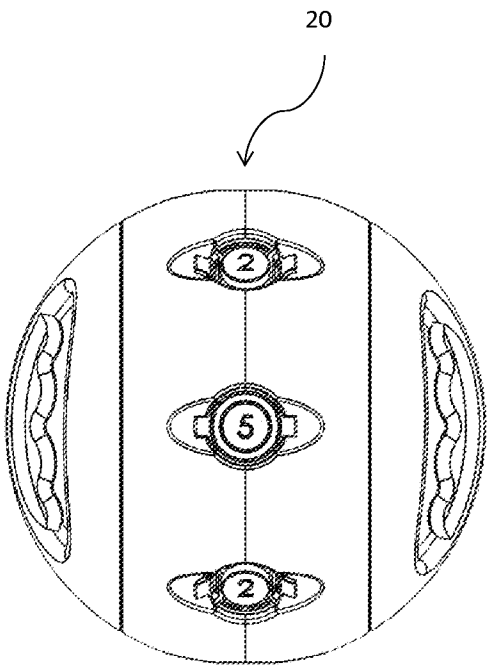
FIG. 30 is a top view of the embodiment shown in FIG. 11.
Figure 32:
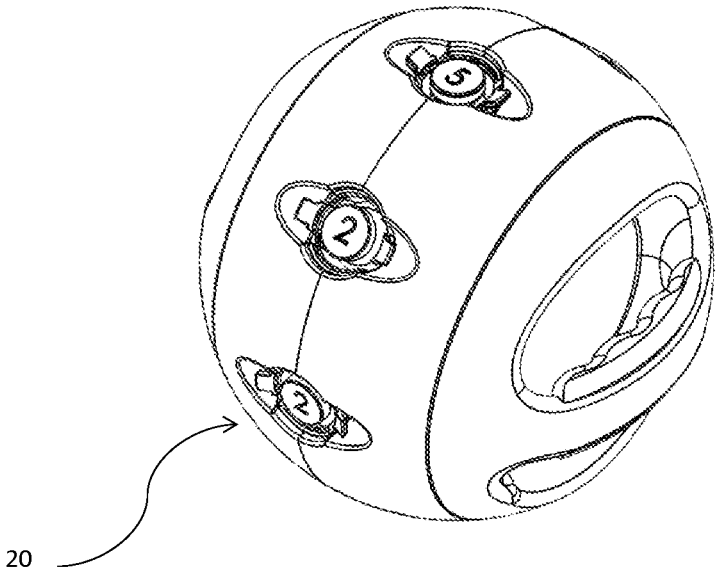
FIG. 32 is a perspective view of the embodiment shown in FIG. 11.
Figure 34:
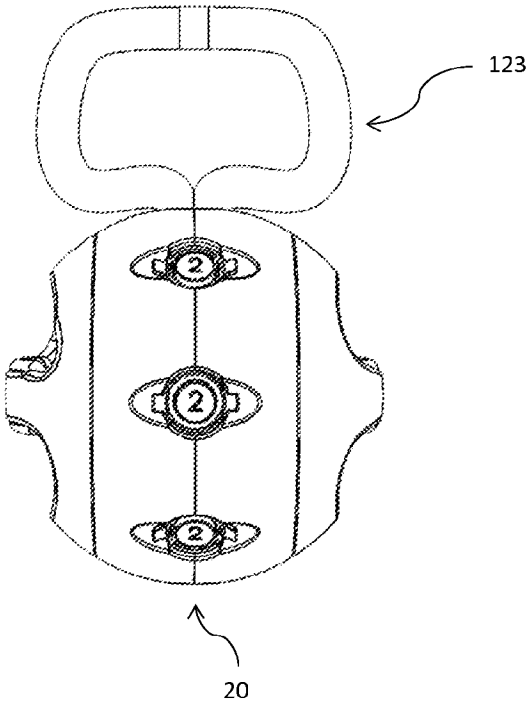
FIG. 34 is a rear view of the embodiment shown in FIG. 22 connected to kettle attachment.
Figure 33:
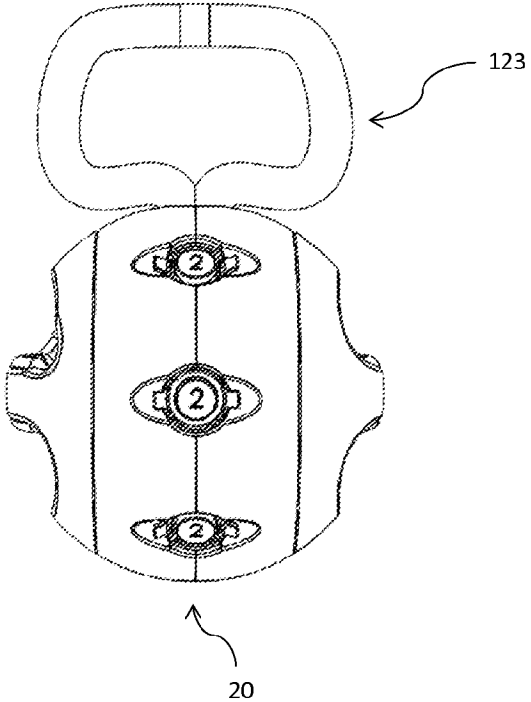
FIG. 33 is a front view of the embodiment shown in FIG. 22 connected to kettle bell attachment.
Figure 36:
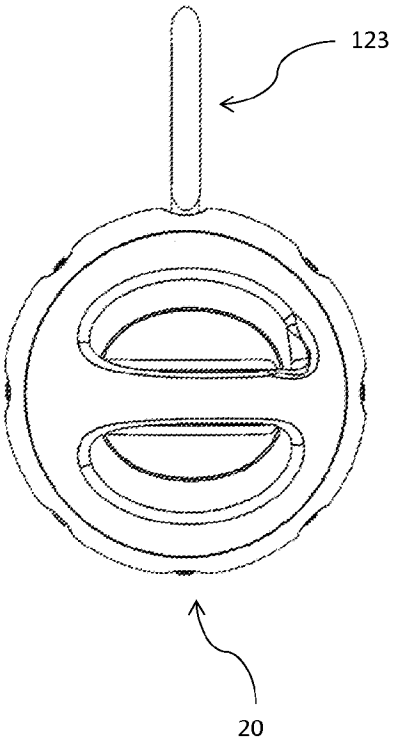
FIG. 36 is an opposite side view of the embodiment shown in FIG. 22 connected to kettle attachment.
Figure 35:
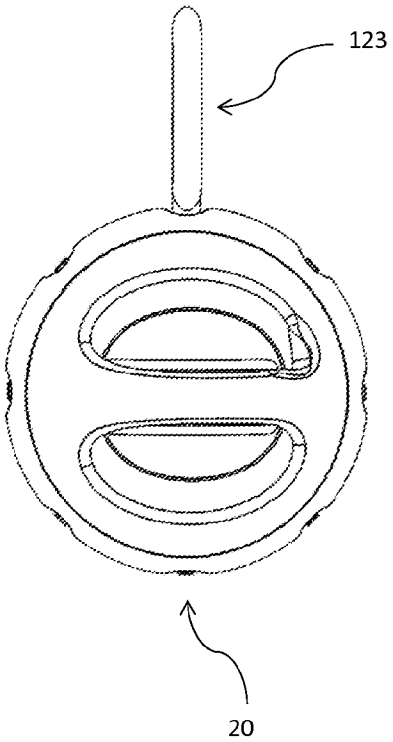
FIG. 35 is a side view of the embodiment shown in FIG. 22 connected to kettle attachment.
Figure 38:
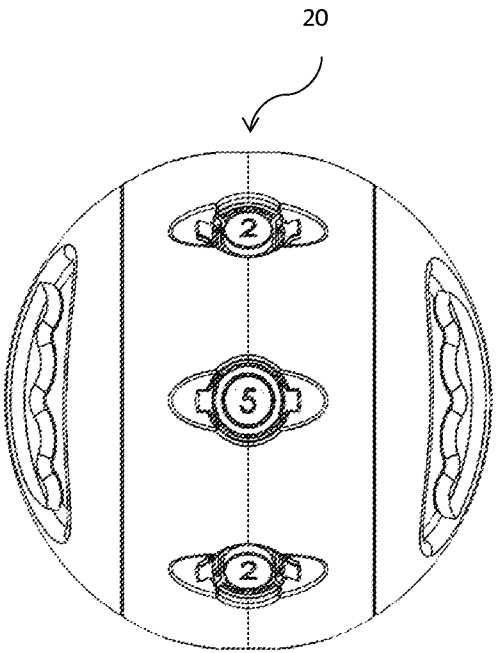
FIG. 38 is a bottom view of the embodiment shown in FIG. 22 connected to kettle attachment.
Figure 37:
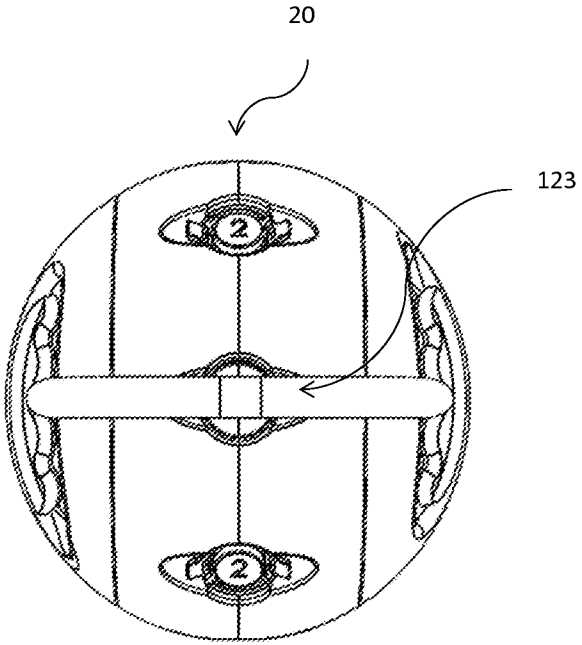
FIG. 37 is a top view of the embodiment shown in FIG. 22 connected to kettle attachment.
Figure 39:
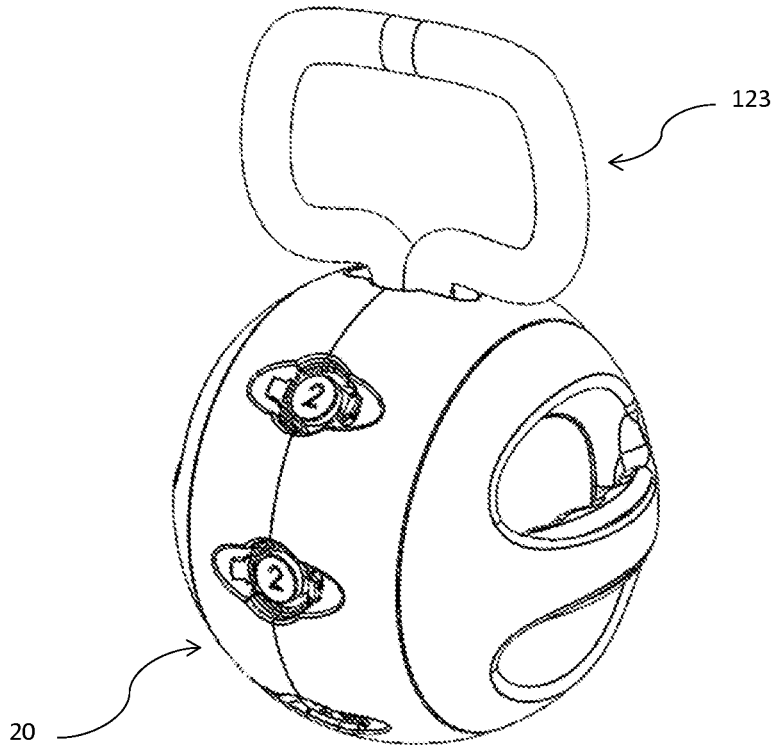
FIG. 39 is a perspective view of the embodiment shown in FIG. 22 connected to kettle attachment.

FIG. 24 shows a front view of kettle bell attachment (123), comprising kettle bell handle (124), kettle bell handle bottom end (125) (not shown), and common base (126). In one embodiment, kettle bell handle bottom end (125) comprises an hour-glass shape similar to the hour-glass shape of weight (52*c*) shown in FIG. 15. Kettle bell handle bottom end (125) is shown permanently attached to common base (126). Common base (126) comprises common base narrow body (126*c*). Common base narrow body (126*c*) is an area wherein the middle sides of common base (126) are more narrow relative to the upper and lower sides of common base (126), whereby common base (126) is shaped like an hour-glass. FIG. 25 is a perspective view of the kettle bell attachment (123) shown in FIG. 24.

Referring to FIGS. 24 and 25, in this embodiment, common base (126) is equivalent to weight cartridge (111) as shown in FIGS. 12, 15, and 18-21 and discussed above in terms of structural features and its hour-glass shape. Likewise, common base (126) comprises slotted sleeve that is located between two opposing common base release ears (126*b*) and further comprises two opposing common base locking tabs (126*a*). Common base locking tabs (126*a*) are raised areas located on the exterior of common base (126). Kettle bell handle bottom end (125) is shaped to fit inside slotted sleeve of common base (126) in a fixed connection that is permanent. Kettle bell handle bottom end (125) should be fixed permanently with common base (126) because it would be undesirable if the trainee were to lift fitness ball from kettle bell handle (124) and kettle bell handle bottom end (125) inadvertently loses its connection from common base (126), causing the fitness ball (20) to drop to the ground and create a safety hazard.

When kettle bell attachment (123) is inserted into one compartment (130*b*) of structure (21), common base locking tabs (126*a*) enter and lock onto compartment recessed area (131), in the same manner as weight cartridge locking tabs (111*c*) enter and lock onto compartment recessed area (131). The connection of kettle bell handle bottom end (125) to common base (126) and the connection of common base locking tabs (126*a*) to compartment recessed area (131), should be sufficiently strong in order to support the entire weight of structure (21) when structure (21) is lifted at kettle bell handle (124).

Referring to FIGS. 22-25, when common base release ears (126*b*) are squeezed together, common base locking tabs (126*a*) are compressed closer together. Compression of common base locking tabs (126*a*) allows common base locking tabs (126*a*) to exit from compartment recessed area (131) (shown in FIG. 15), thereby causing common base (126), and consequently, kettle bell attachment (123), to be simultaneously released and removed from compartment (130*b*). Release of common base (126) and kettle bell attachment (123) from compartment (130*b*) is performed in a similar manner as the release of weight cartridge (111) and weight (52*c*) from compartment (130*b*) as previously discussed.

Thus, common base locking tabs (126*a*) give the trainee the option to insert kettle bell attachment (123) into one compartment (130*b*) of structure (21) to provide an alternate means of lifting structure (21) by gripping kettle bell handle (124). Optionally, additional kettle bell attachments (123) can be inserted and attached to an unoccupied compartment (130*b*) of structure (21) to provide yet another means to lift structure (21) at kettle bell handle (124) and to permit varying hand hold positions for the trainee to hold fitness ball (20).

It will be appreciated to those skilled in the art with the present disclosure that other embodiments of kettle bell attachment (123) can be derived that comprise kettle bell handle bottom end (125) and common base (126) of alternative shapes other than hour-glass shapes, e.g. cylindrically-shaped, that could be removably inserted into compartment (130*b*). In addition, it will be recognized by those skilled in the art that other embodiments of kettle bell attachment (123) can be derived, for example, a kettle bell attachment (123) comprising a kettle bell handle bottom end (125), further comprising release ears and locking tabs, that can be removably inserted directly into compartment (130*b*), without the presence of common base (126). Other mechanisms for removably securing a kettle ball handle to the ball will be apparent to those having the benefit of the present disclosure.

FIGS. 26-32 depict various views of the embodiment shown in FIG. 11 from the front, rear, side, opposite side, top, bottom, and perspective views.

FIGS. 33-39 depict various views of the embodiment shown in FIG. 22 connected to kettle bell attachment, from the front, rear, side, opposite side, top, bottom, and perspective views.

All references referred to herein are incorporated herein by reference. While the apparatus of this invention have been described in terms of preferred embodiments, it will be apparent to those of skill in the art that variations may be applied to the apparatus described herein without departing from the concept and scope of the invention. All such similar substitutes and modifications apparent to those of ordinary skill in the art are deemed to be within the scope and concept of the invention. Those of ordinary skill in the art will recognize that the apparatus of the present invention has many applications, and that the present invention is not limited to the representative examples disclosed herein. Moreover, the scope of the present invention covers conventionally known variations and modifications to the components described herein, as would be known by those of ordinary skill in the art. While the apparatus of this invention have been described in terms of preferred or illustrative embodiments, it will be apparent to those of ordinary skill in the art that variations may be applied to the apparatus described herein without departing from the concept and scope of the invention. All such similar substitutes and modifications apparent to those of ordinary skill in the art are deemed to be within the scope and concept of the invention as it is set out in the following claims.

What is claimed is:

1. An athletic apparatus comprising:

a geometrical structure having an interior area with a first removable cover and an opposing and in parallel relation second removable cover, the first cover and the opposing second cover being independently rotationally mounted to the geometrical structure;

handles attached to an outer surface area of the first and second covers;

an internal chamber centrally disposed within the interior area of the geometrical structure, the internal chamber slidably receiving a shaft member;

one or more compartments disposed along a longitudinal axis of the shaft member, each of the one or more compartments having an aperture configured to receive a weight of a predetermined weight amount; and a push button located on an exterior surface area of the geometrical structure being operationally connected through the interior area of the geometrical structure to the shaft member wherein depression of the push button causes the shaft member to be released from the internal chamber.

2. An athletic apparatus comprising:

a geometrical structure having an interior area with a first removable cover and an opposing and in parallel relation second cover, the first cover and the opposing second cover being independently rotationally mounted to the geometrical structure;

handles attached to an outer surface area of the first and second covers;

an internal chamber centrally disposed within the interior area of the geometrical structure, wherein the internal chamber comprises a recessed lip and the recessed lip comprises a recessed lip indented area, the internal chamber slidably receiving a shaft member;

one or more compartments disposed along a longitudinal axis of the shaft member, each of the one or more compartments having an aperture configured to receive a weight of a predetermined weight amount; and a release button located on the exterior surface of the first removable cover, of the geometrical structure, whereby the opposite end of the release button comprises a release button hook that locks onto the recessed lip indented area, wherein depression of the release button causes the release button hook to unlock from the recessed lip indented area, thereby causing the first removable cover and shaft member to be simultaneously released from the internal chamber.

3. The athletic apparatus of claim 2, wherein the geometrical structure is spherical.

4. The athletic apparatus of claim 2, wherein the first and second covers further comprise a recessed section directly below the handles forming a gripping area for a hand of a user.

5. The athletic apparatus of claim 2, wherein the handles further comprise grips.

6. An athletic apparatus comprising:

a geometrical structure having a main body comprising an interior area, an outer surface, a first cover and a second cover opposing and in parallel relation with the first cover, the first cover and the opposing second cover being independently rotationally mounted to opposing sides of the main body;

handles attached to an outer surface area of each of the first and second covers; and one or more compartments located about the outer surface of the main body, each of the one or more compartments configured for receiving and removing a weight of a predetermined weight amount wherein the one or more compartments are accessible, for receiving and removing the weight, from the outer surface of the main body.

7. The athletic apparatus of claim 6, wherein the geometrical structure is spherical.

8. The athletic apparatus of claim 6, wherein the first and second covers further comprise a recessed section directly below the handles forming a gripping area for a hand of a user.

9. The athletic apparatus of claim 6, wherein the handles comprise grips.

10. The athletic apparatus of claim 6, wherein the one or more compartments extend inwardly into the interior area.

11. The athletic apparatus of claim 6, wherein the opposed covers rotate about an axis, and wherein the one or more compartments are spaced radially about the axis on the geometrical structure outer surface.

12. The athletic apparatus of claim 11, wherein the one or more compartments comprise a plurality of evenly spaced-apart compartments that are flush with the geometrical structure outer surface and extend inwardly therefrom into the interior area.

13. The athletic apparatus of claim 12 further comprising eight compartments.

14. The athletic apparatus of claim 6 further comprising one or more weight cartridges capable of receiving and holding one of the weights, the one or more weight cartridges being insertable into and removable from the one or more compartments.

15. The athletic apparatus of claim 14, wherein the weight cartridge further comprises two opposing weight cartridge locking tabs and two opposing weight cartridge release ears.

16. The athletic apparatus of claim 15, wherein the weight further comprises a weight grip to assist in removal of the weight.

17. The athletic apparatus of claim 6 further comprising a kettle bell attachment attached to the geometrical structure.

18. The athletic apparatus of claim 17, whereby the kettle bell attachment is removably attachable to one of the one or more compartments.

19. The athletic apparatus of claim 18, wherein the kettle bell attachment further comprises a kettle bell handle, a kettle bell handle bottom end, and a common base, whereby the kettle bell handle bottom end is permanently connected to the common base, and the common base is removably connectable to the one or more compartments.

20. The athletic apparatus of claim 19, whereby the common base further comprises two opposing common base locking tabs and two opposing common base release ears.

21. An athletic apparatus comprising:

a geometrical structure having a main body comprising an interior area, an outer surface, a first cover and a second cover opposing and in parallel relation with the first cover, the first cover and the opposing second cover being independently rotationally mounted to opposing sides of the main body;

handles attached to an outer surface area of each of the first and second covers;

one or more compartments located about the outer surface of the main body, each of the one or more compartments configured for receiving a weight of a predetermined weight amount; and one or more weight cartridges capable of receiving and holding one of the weights, the one or more weight cartridges being insertable into and removable from the one or more compartments; wherein the weight cartridge further comprises two opposing weight cartridge locking tabs and two opposing weight cartridge release ears.

22. The athletic apparatus of claim 21, wherein the weight further comprises a weight grip to assist in removal of the weight.

23. An athletic apparatus comprising:

a geometrical structure having a main body comprising an interior area, an outer surface, a first cover and a second cover opposing and in parallel relation with the first cover, the first cover and the opposing second cover being independently rotationally mounted to opposing sides of the main body;

handles attached to an outer surface area of each of the first and second covers;

one or more compartments located about the outer surface of the main body, each of the one or more compartments configured for receiving a weight of a predetermined weight amount; and a kettle bell attachment attached to the geometrical structure; whereby the kettle bell attachment is removably attachable to one of the one or more compartments; wherein the kettle bell attachment further comprises a kettle bell handle, a kettle bell handle bottom end, and a common base, whereby the kettle bell handle bottom end is permanently connected to the common base, and the common base is removably connectable to the one or more compartments; and whereby the common base further comprises two opposing common base locking tabs and two opposing common base release ears.

* * * * *